US012529505B2

(12) United States Patent
Park et al.

(10) Patent No.: US 12,529,505 B2
(45) Date of Patent: Jan. 20, 2026

(54) REFRIGERATOR

(71) Applicant: LG ELECTRONICS INC., Seoul (KR)

(72) Inventors: Kyong Bae Park, Seoul (KR); Sangbok Choi, Seoul (KR); Sungwook Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 176 days.

(21) Appl. No.: 18/019,440

(22) PCT Filed: Jul. 19, 2021

(86) PCT No.: PCT/KR2021/009256
§ 371 (c)(1),
(2) Date: Feb. 2, 2023

(87) PCT Pub. No.: WO2022/030809
PCT Pub. Date: Feb. 10, 2022

(65) Prior Publication Data

US 2023/0280081 A1 Sep. 7, 2023

(30) Foreign Application Priority Data

Aug. 6, 2020 (KR) ..... 10-2020-0098362

(51) Int. Cl.
*F25D 21/00* (2006.01)
*F25D 21/02* (2006.01)

(52) U.S. Cl.
CPC ..... *F25D 21/004* (2013.01); *F25D 21/02* (2013.01)

(58) Field of Classification Search
CPC ..... F25D 21/006; F25D 2400/04; F25D 2700/12; F25D 21/02; F25B 2700/2117; F25B 2600/112; F25B 2400/01
See application file for complete search history.

(56) References Cited

U.S. PATENT DOCUMENTS 3,355,904 A * 12/1967 Sutton, Jr. ..... G05D 11/13 73/196
4,348,870 A * 9/1982 Stein ..... G01K 17/08 374/E17.008
5,460,010 A * 10/1995 Kobayashi ..... F25D 17/065 62/154

(Continued)

FOREIGN PATENT DOCUMENTS

CN 110579069 A 12/2019
JP 05-010654 A 1/1993

(Continued)

OTHER PUBLICATIONS

International Search Report from PCT/KR2021/009256 dated Nov. 3, 2021.

*Primary Examiner* — Jianying C Atkisson
*Assistant Examiner* — Meraj A Shaikh
(74) *Attorney, Agent, or Firm* — Bryan Cave Leighton Paisner LLP

(57) ABSTRACT

A refrigerator in which a performance cycle for a next frost detection operation according to a logic temperature (ΔHt) checked through a frost detection operation may be changed. Thus, unnecessary power consumption may be reduced and power consumption efficiency may be improved.

14 Claims, 18 Drawing Sheets

(56) References Cited

U.S. PATENT DOCUMENTS

| | | | | |
|---|---|---|---|---|
| 5,463,875 | A * | 11/1995 | Shavit | F25D 21/02 62/140 |
| 6,467,282 | B1 * | 10/2002 | French | F25D 21/006 62/151 |
| 9,557,091 | B1 * | 1/2017 | Zardo | F25D 23/061 |
| 2018/0313596 | A1 | 11/2018 | Lee et al. | |

FOREIGN PATENT DOCUMENTS

| | | | |
|---|---|---|---|
| KR | 10-1998-0003399 | A | 3/1998 |
| KR | 10-2013-0034816 | A | 4/2013 |
| KR | 10-1445924 | B1 | 9/2014 |
| KR | 10-2019-0101669 | A | 9/2019 |
| KR | 10-2019-0106201 | A | 9/2019 |
| KR | 10-2019-0106242 | A | 9/2019 |
| KR | 10-2019-0112482 | A | 10/2019 |
| WO | 2019190113 | A1 | 10/2019 |
| WO | 2019190114 | A1 | 10/2019 |

* cited by examiner

【Figure 1】
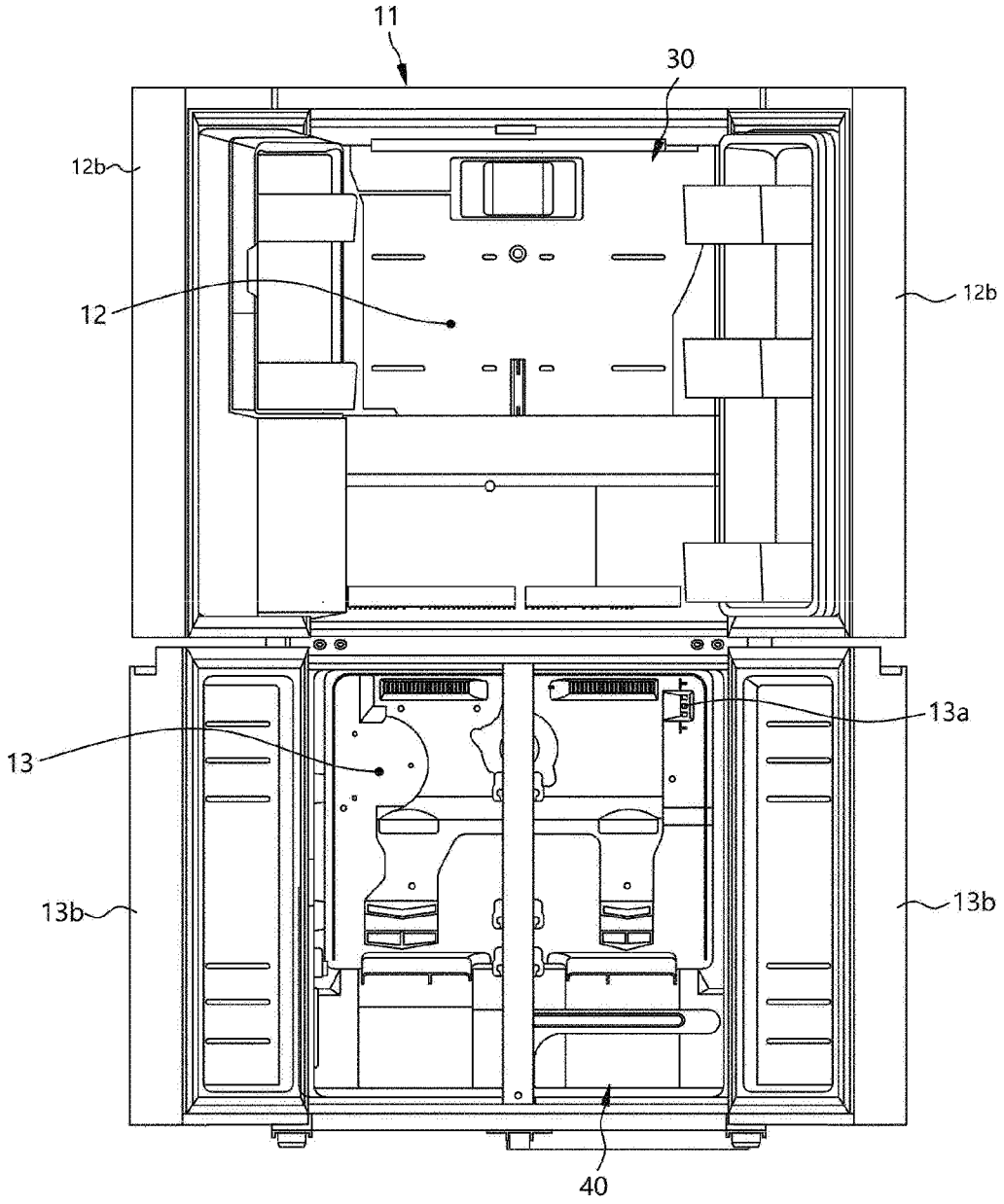

【Figure 2】
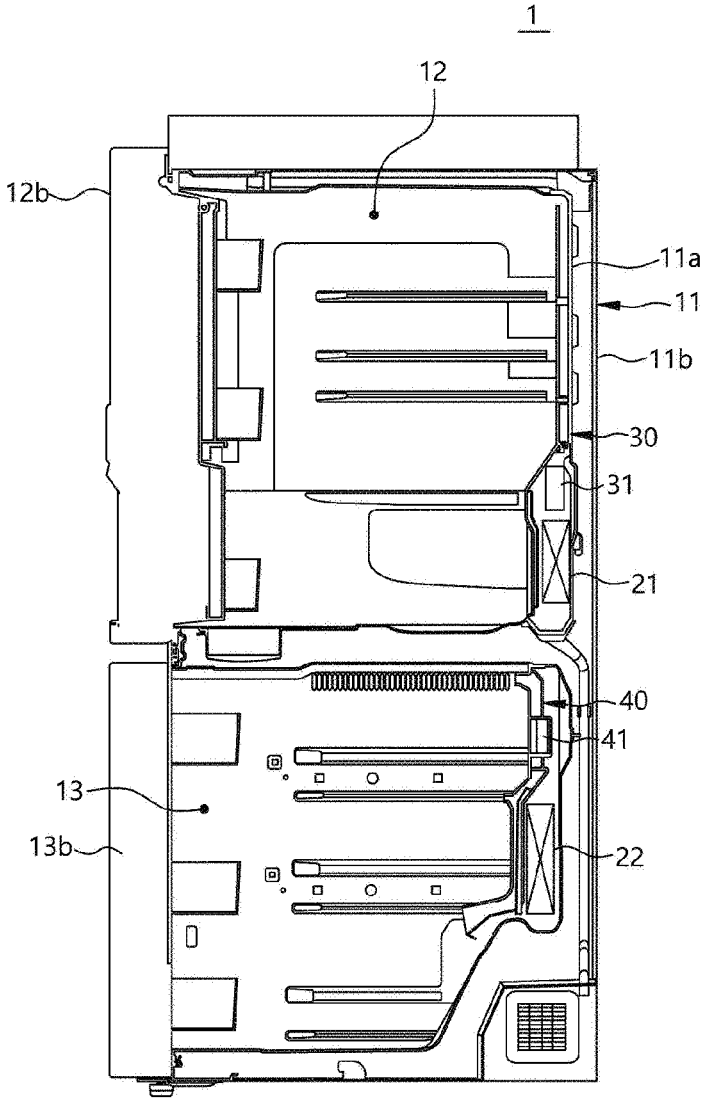

【Figure 3】
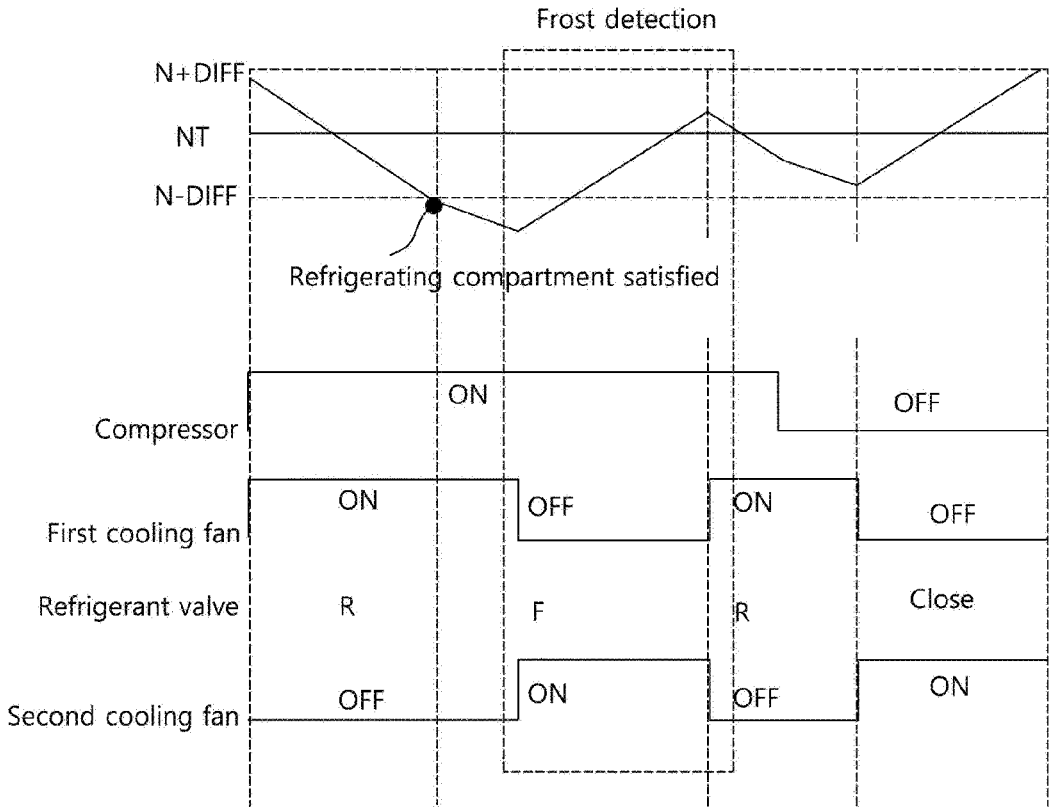
【Figure 4】
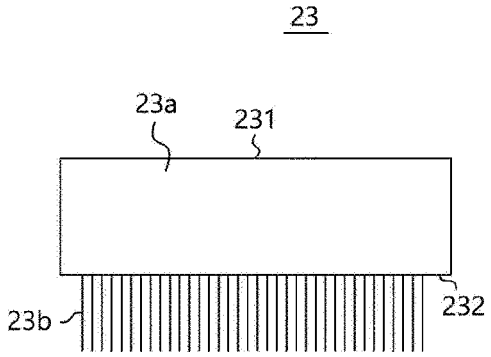

【Figure 5】
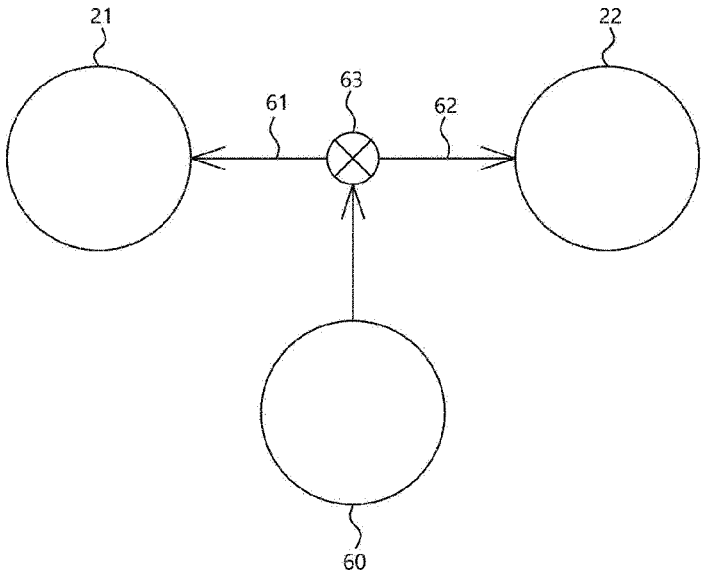

【Figure 6】
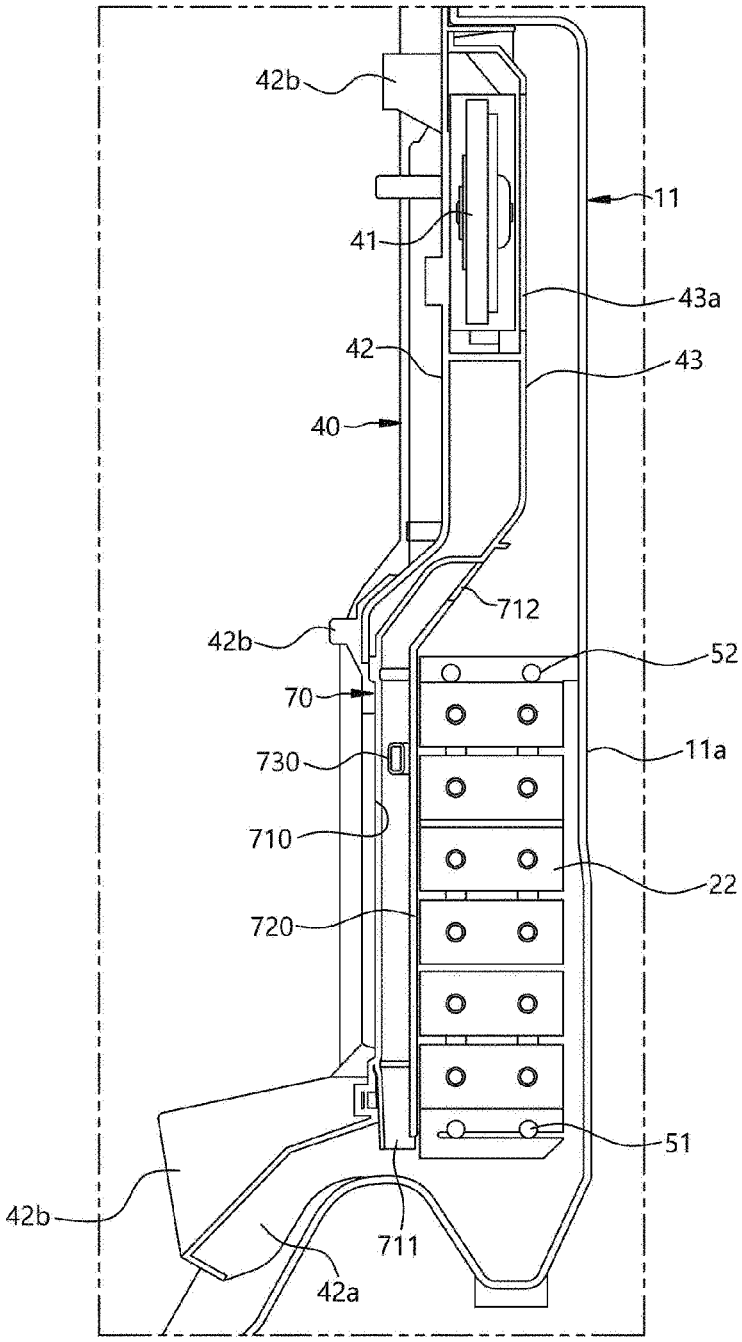

【Figure 7】
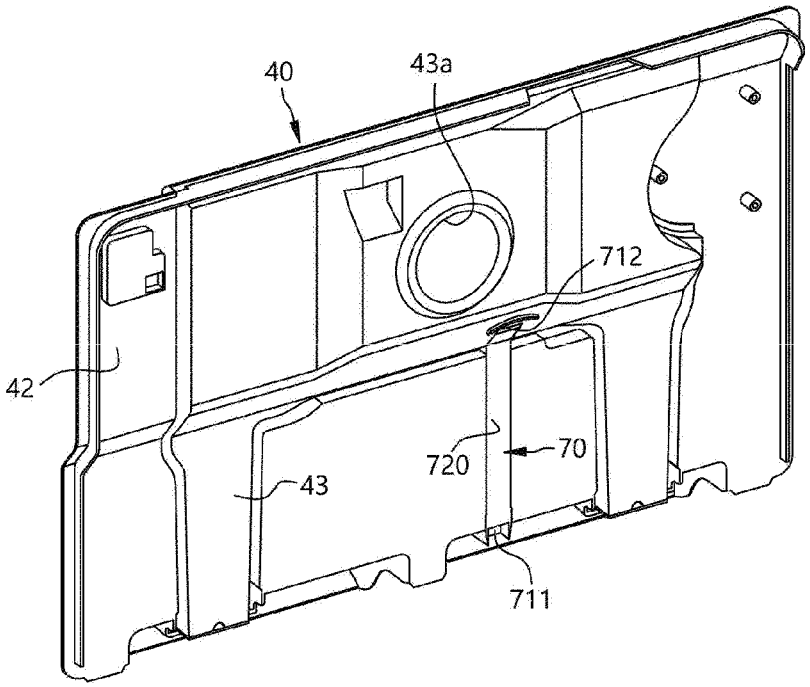

【Figure 8】
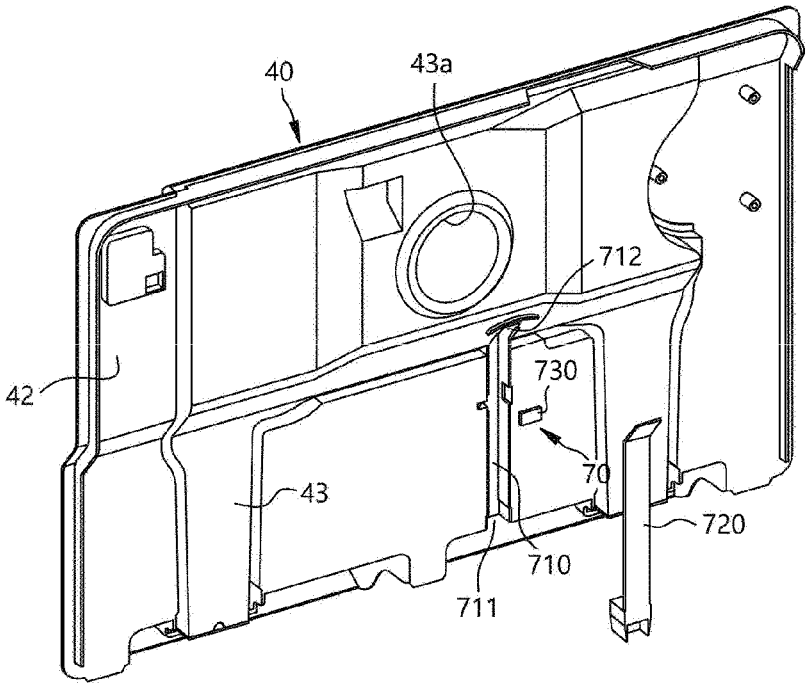

【Figure 9】
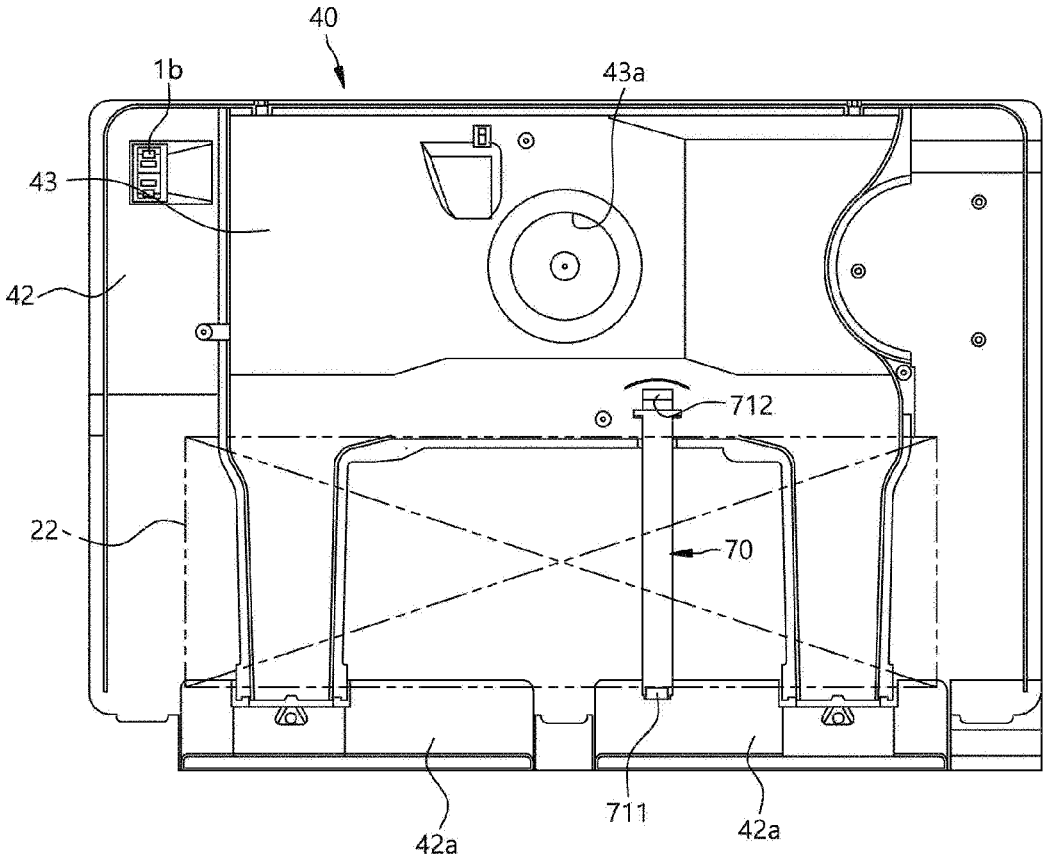

【Figure 10】
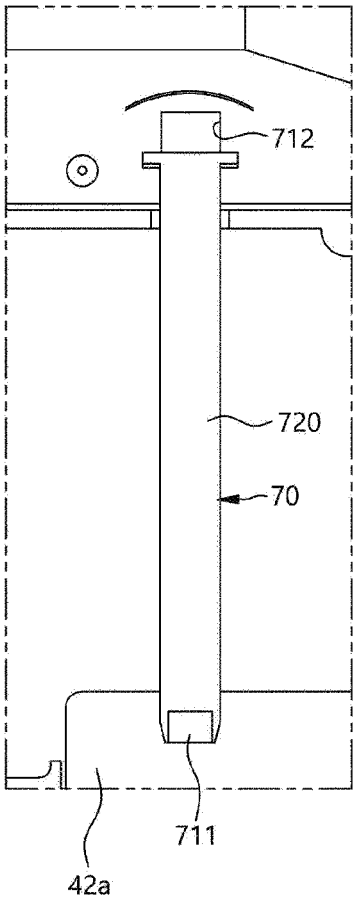

【Figure 11】
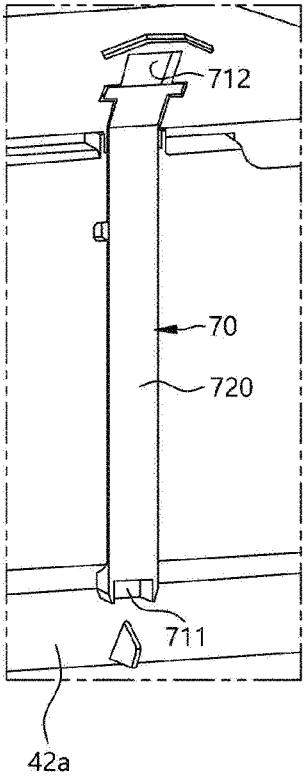

【Figure 12】
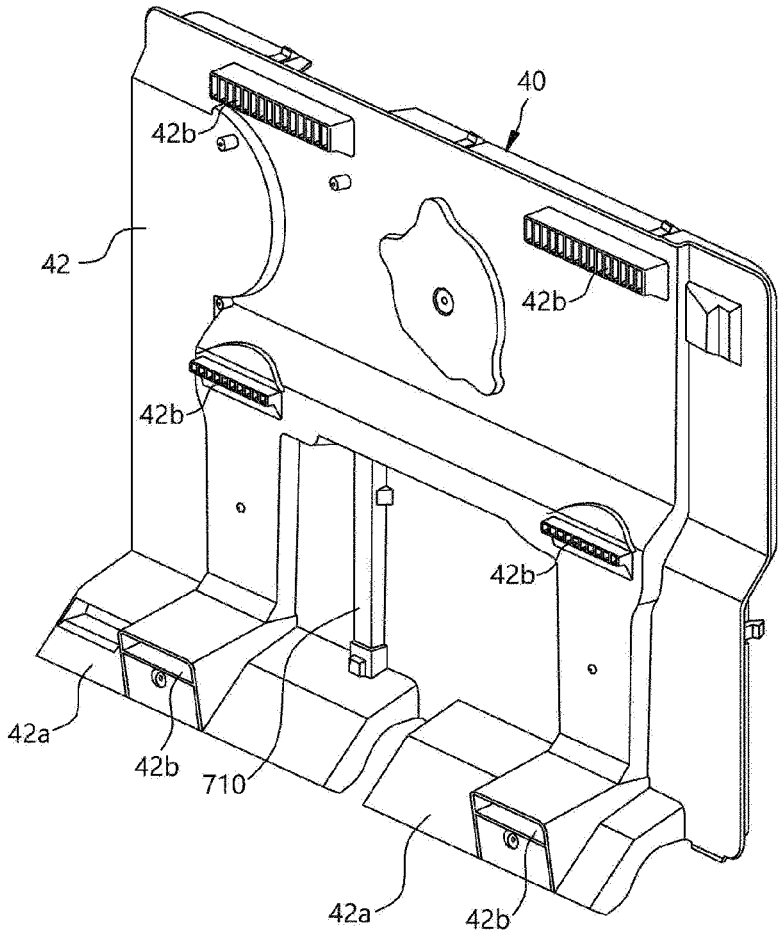

【Figure 13】
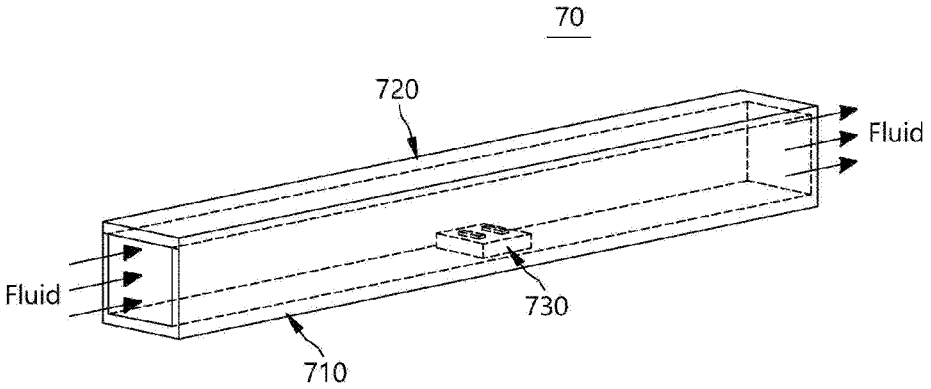
【Figure 14】
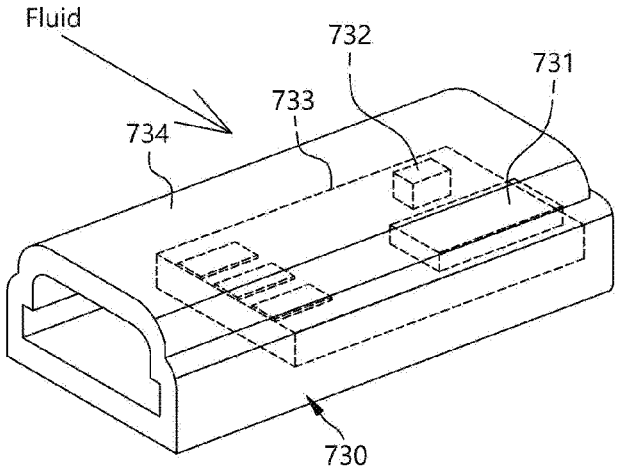

【Figure 15】
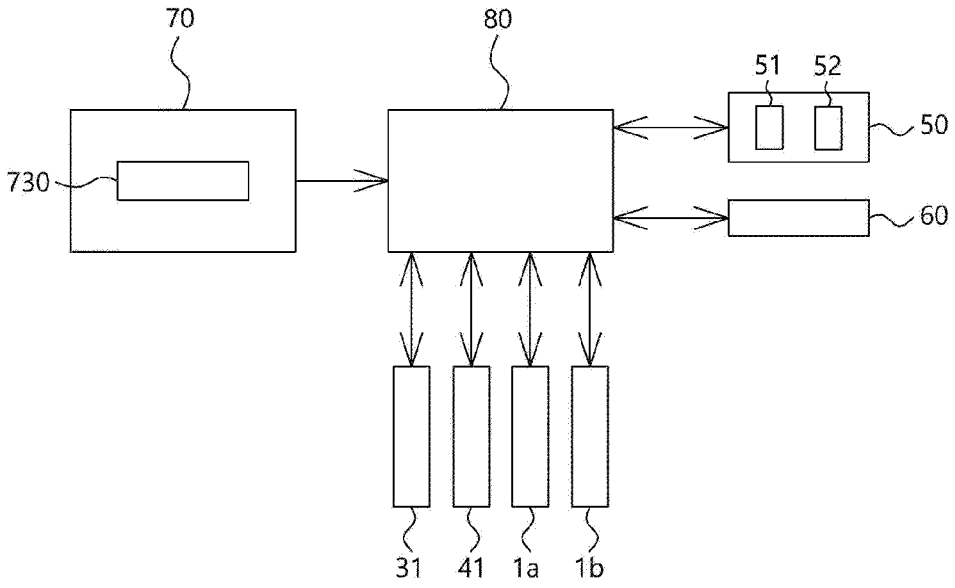
【Figure 16】
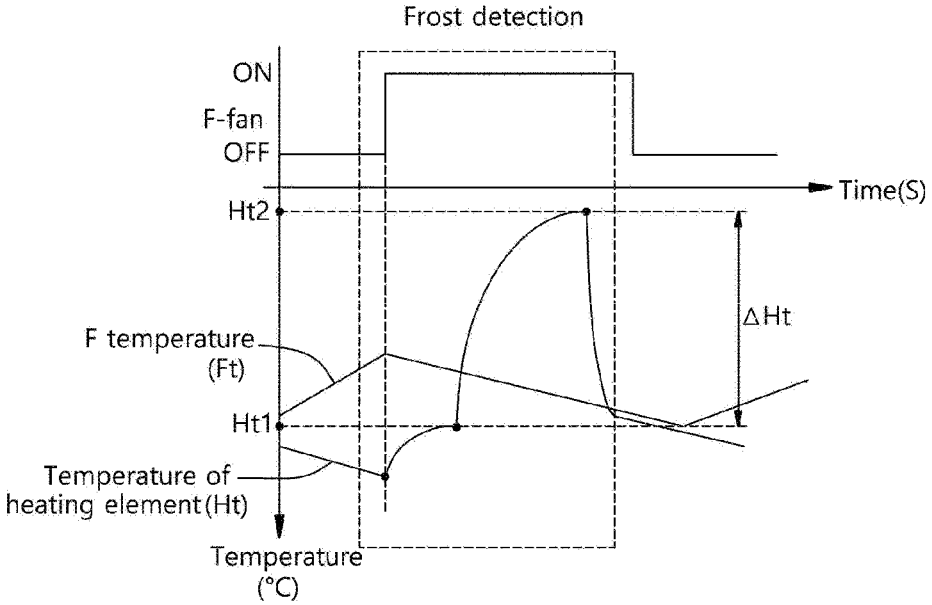

【Figure 17】
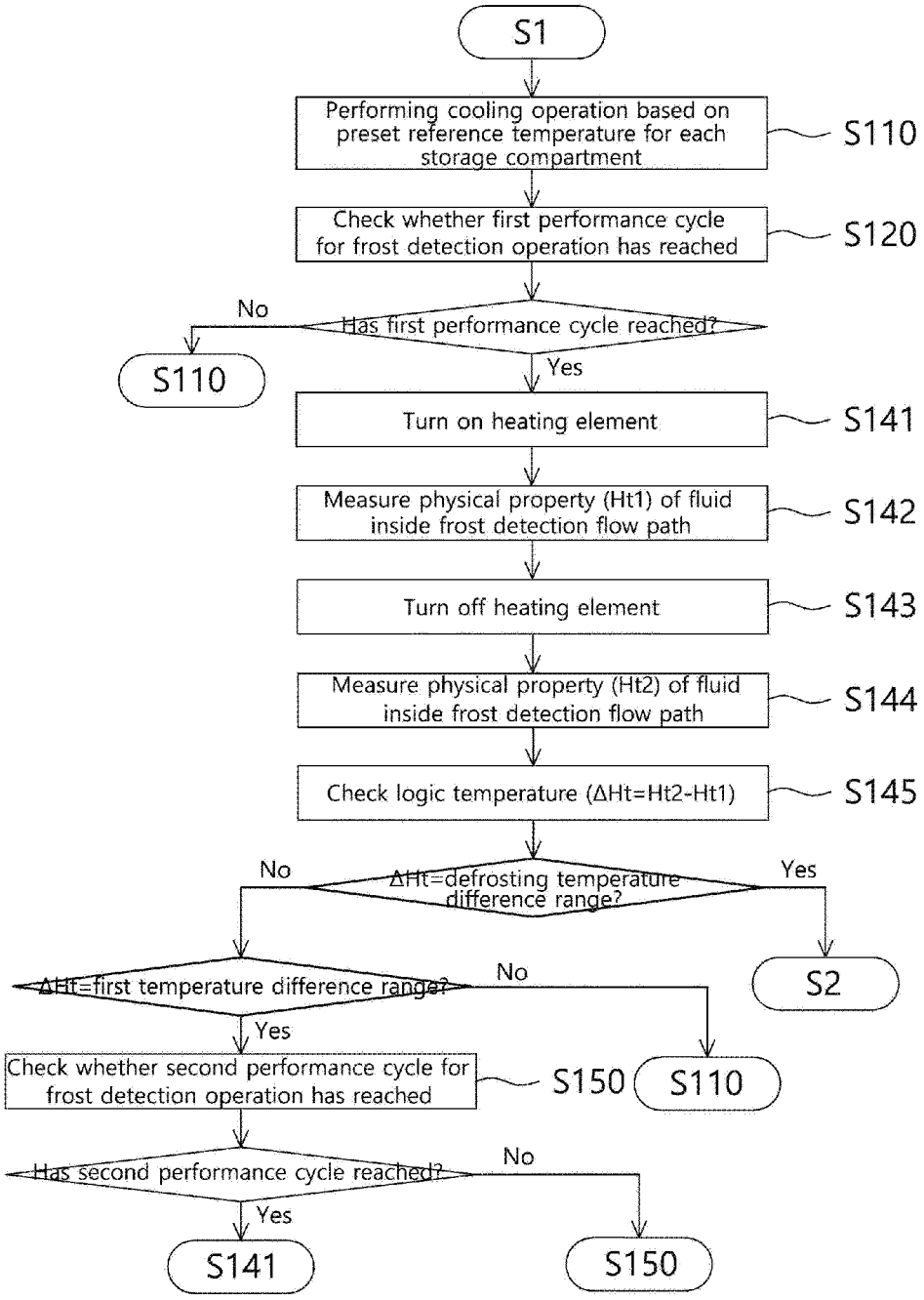

【Figure 18】
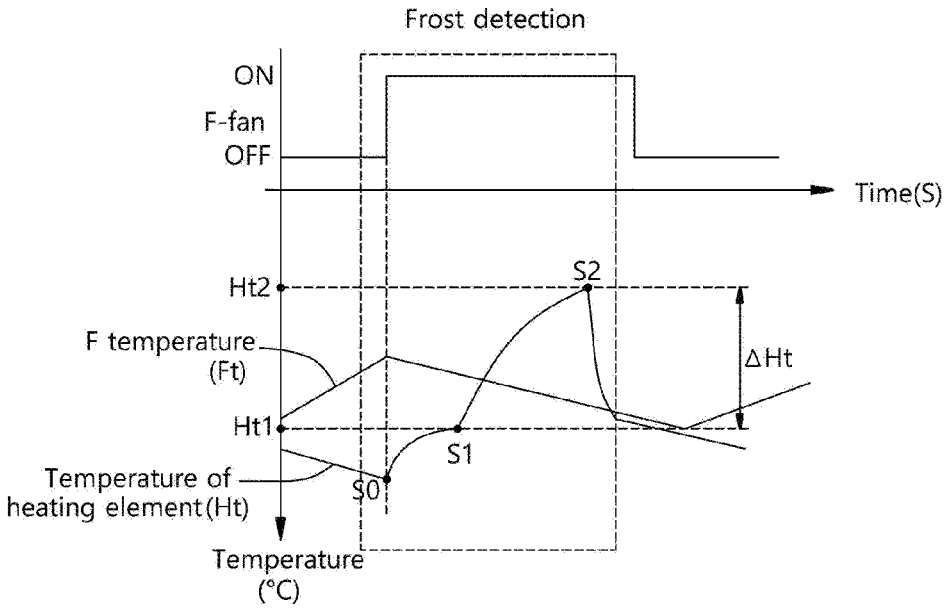

【Figure 19】
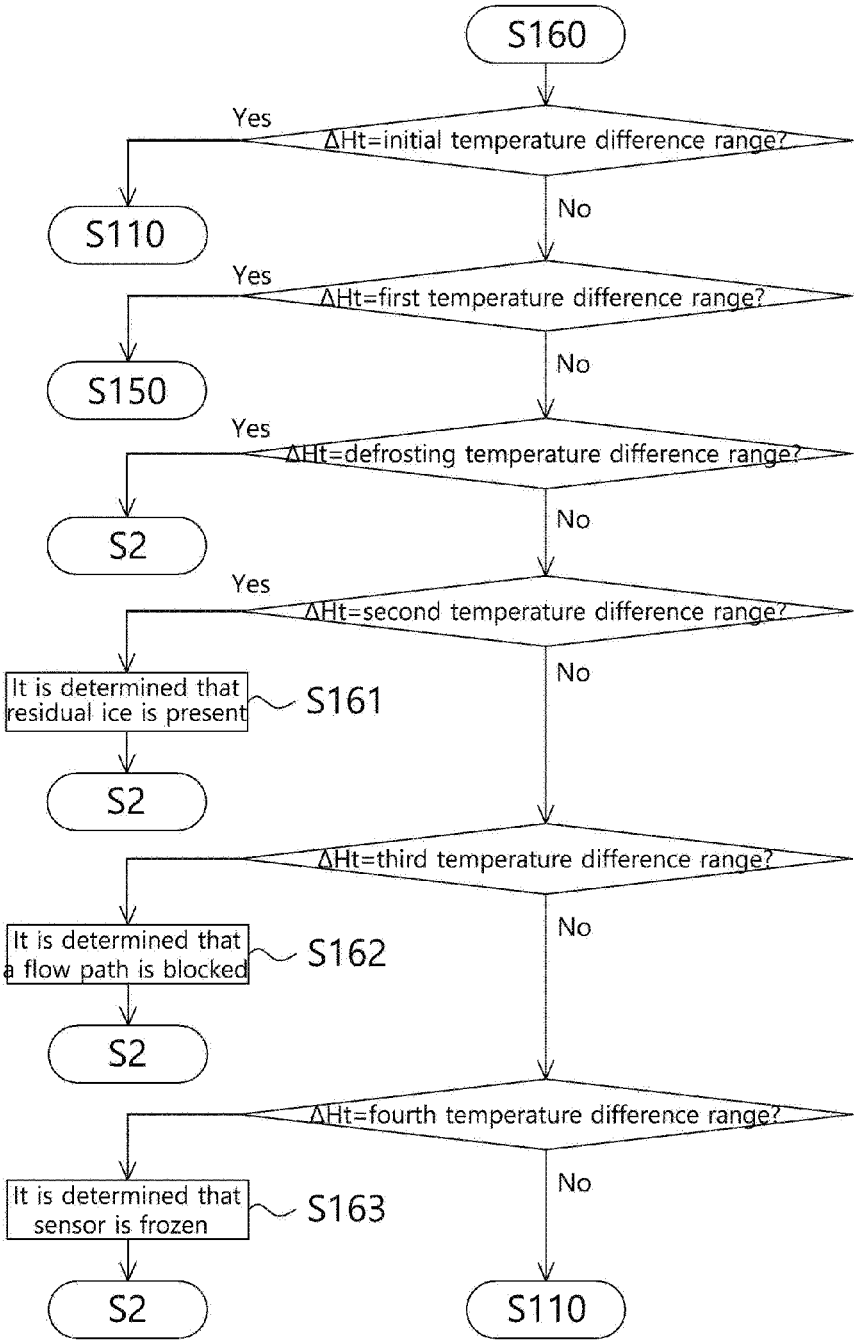

【Figure 20】
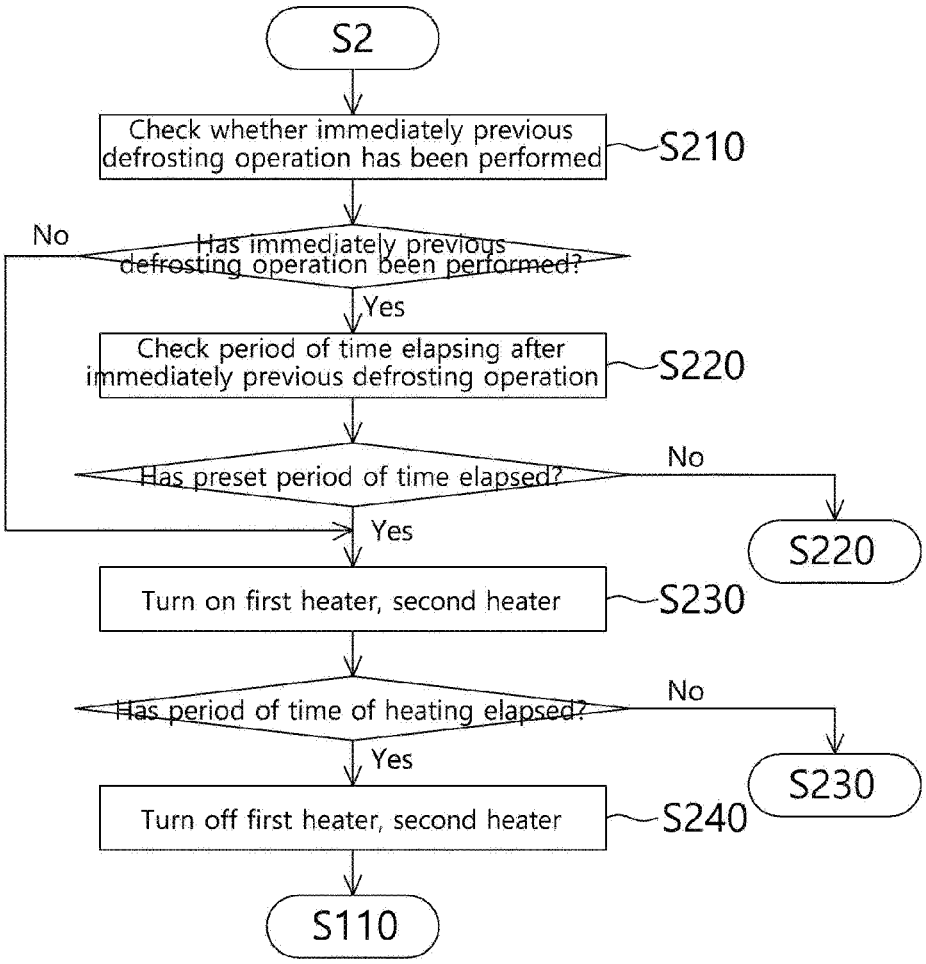

【Figure 21】
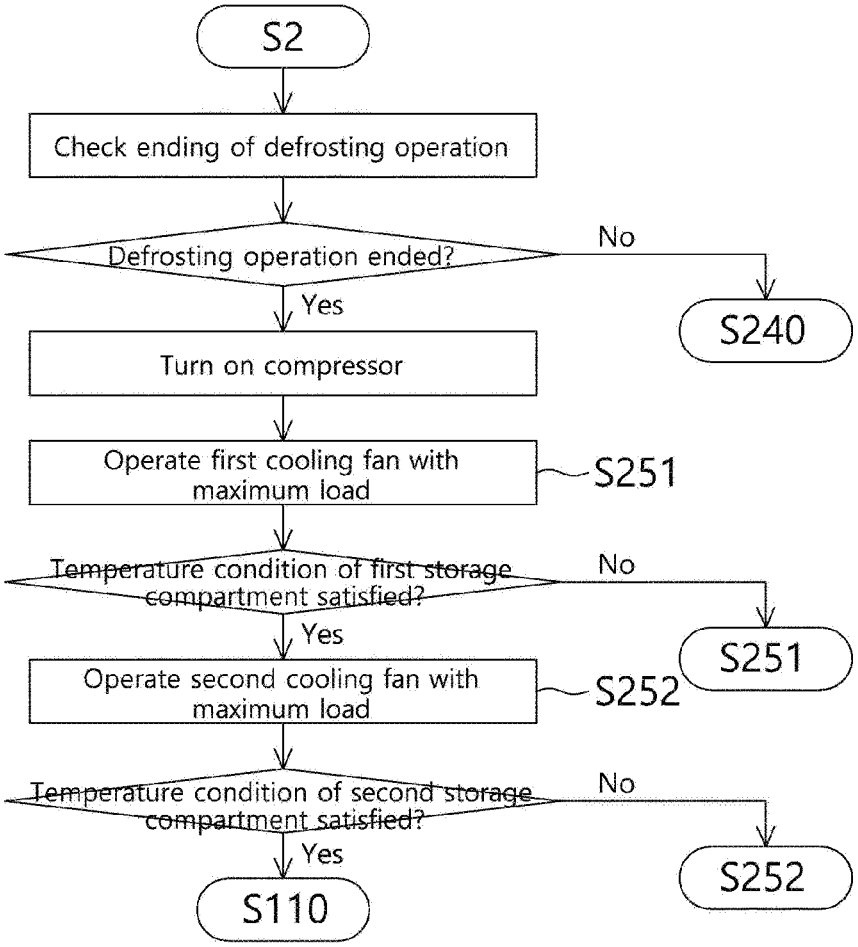

REFRIGERATOR

CROSS-REFERENCE TO RELATED APPLICATIONS

This application is a National Stage of International Application No. PCT/KR2021/009256, filed on Jul. 19, 2021, which claims the benefit of Korean Patent Application No. 10-2020-0098362, filed on Aug. 6, 2020, the contents of which are all hereby incorporated by reference herein in their entirety.

TECHNICAL FIELD

The present disclosure relates to a refrigerator in which by using physical property checked for frost detection, frost formed on a cold air source may be detected and other various information related to the frost may be checked so as to minimize impact on the operation of the refrigerator so that energy efficiency thereof may be improved, and an operation control method therefor.

BACKGROUND

Generally, a refrigerator is an appliance that uses cold air to store items stored in storage space for a long time or while maintaining at a constant temperature.

The refrigerator is provided with a refrigeration system including one or more evaporators and is configured to generate and circulate the cold air.

Here, the evaporator serves to maintain air inside the refrigerator within a preset temperature range by exchanging heat between a low-temperature and low-pressure refrigerant and the air inside the refrigerator (cold air circulating inside the refrigerator).

While the evaporator is exchanging heat with the internal air of the refrigerator, frost may be formed on the evaporator due to at least one of water or moisture contained in the internal air and moisture present around the evaporator.

In a conventional technology, a defrosting operation is performed to remove frost formed on the surface of the evaporator when a certain time has elapsed after the operation of the refrigerator has started.

That is, in the conventional technology, the defrosting operation is performed through indirect estimation based on the operation time of the refrigerator, rather than directly detecting the amount of frost formed on the surface of the evaporator.

Accordingly, in the conventional technology, even if frost is not formed, the defrosting operation may be performed, thereby decreasing power consumption efficiency, or even if frost is excessively formed, the defrosting operation may not be performed.

Particularly, the defrosting operation is performed by operating a heater to increase a temperature around the evaporator, and after the defrosting operation is performed, the refrigerator is operated with a large load to rapidly reach a preset temperature therein, thereby causing high power consumption.

Accordingly, various studies are being conducted to shorten a period of time of the defrosting operation or a cycle of the defrosting operation.

Recently, in order to accurately check the amount of frost formed on the surface of the evaporator, a method using temperature or pressure difference between the inlet side and outlet side of the evaporator has been proposed. This is disclosed in Korean Patent Application Publication Nos. 10-2019-0101669, 10-2019-0106201, 10-2019-0106242, 10-2019-0112482, and 10-2019-0112464.

In the technology described above, a guide flow path (a bypass flow path) configured to have an air flow separate from the flow of air passing through an evaporator is formed in a cold air duct, and the difference of a temperature changing according to the amount of air passing through the guide flow path due to frost formed on the evaporator is measured so that the amount the frost may be checked.

Accordingly, the amount of frost may be substantially checked, and based on the amount of the frost checked in this manner, the starting time of a defrosting operation may be accurately determined.

Particularly, the technology disclosed in Korean Patent Application Publication No. 10-2019-0112482 described above proposes a control method in which based on difference between a first temperature as a lowest value and a second temperature as a highest value among temperatures detected by a sensor, the defrosting operation is performed, whether a sensor fails is determined, and whether a flow path in heat exchange space is blocked is checked.

Meanwhile, in the technology described above, every time in which the frost detection operation is performed, the heating element generates heat so as to heat the inside of the guide flow path.

Particularly, the frost detection operation described above is controlled to be repeatedly performed at every determined cycle. That is, from the time in which the defrosting operation stops, the frost detection operation is periodically performed to accurately determine whether or not frost is formed.

However, in the control from such technology, when it is considered that frost formation is extremely rare immediately after the defrosting operation is performed, the frost detection operation immediately after the defrosting operation may be essentially meaningless.

Accordingly, due to the performance of a meaningless frost detection operation, power is unavoidably consumed, and thus power consumption efficiency decreases.

In addition, in the method of the technology described above, the loss of cooling capability in a refrigerator is not considered.

That is, in the technology described above, when defrosting is not completely performed despite the performance of the defrosting operation, the defrosting operation is repeatedly performed until the defrosting is completely performed, and in so doing, the cooling capability in the refrigerator is lost, and items (frozen items) stored in the refrigerator may melt or be spoiled.

Particularly, there may be various reasons for the defrosting operation to be performed repeatedly in a short period of time, and a case in which the defrosting operation is performed repeatedly several times is a case in which the above problem is not solved, and the same phenomenon may be repeated in a state which is not recognized by a user.

SUMMARY

The present disclosure has been made to solve above problems and is intended to enable a frost detection operation to be performed in consideration of the end time of a defrosting operation so that power consumption due to frequent performance of the frost detection operation may be decreased and power consumption efficiency may be improved.

The present disclosure is intended to control cooling capability in a refrigerator so that the cooling capability is not lost even if there is a problem with the defrosting operation such that stored items may be prevented from being spoiled due to melting thereof.

In order to accomplish this, an operation control method for a refrigerator of the present disclosure may include a process of performing a frost detection operation according to a first performance cycle when a logic temperature ΔHt checked after a defrosting operation is performed is within a set initial temperature difference range.

In addition, the operation control method for a refrigerator of the present disclosure may include a process of performing a frost detection operation according to a second performance cycle when the logic temperature ΔHt checked after the defrosting operation is performed is within a first temperature difference range between the set initial temperature difference range and a defrosting temperature difference range.

Particularly, according to the operation control method for a refrigerator of the present disclosure, the first performance cycle may include a process of being controlled to have a longer term of time than the second performance cycle. Accordingly, the performance of a meaningless frost detection operation may be omitted, thereby decreasing power consumption and improving consumption efficiency.

In addition, according to the operation control method for a refrigerator of the present disclosure, the logic temperature ΔHt may be difference between a highest temperature and a lowest temperature in a frost detection flow path.

In addition, according to the operation control method for a refrigerator of the present disclosure, the initial temperature difference range may be divided into at least two temperature difference ranges.

Furthermore, according to the operation control method for a refrigerator of the present disclosure, the performance cycle of each of the frost detection operations performed in each of the temperature difference ranges may be controlled to have a shorter term of time as the logic temperature ΔHt decreases. Accordingly, even if frost is rapidly formed, the defrosting operation may be performed at an accurate time.

Additionally, according to the operation control method for a refrigerator of the present disclosure, the second performance cycle of each of the frost detection operations performed in the first temperature difference range may be controlled to be performed in a cycle of the same term of time regardless of the logic temperature ΔHt.

In addition, according to the operation control method for a refrigerator of the present disclosure, the second performance cycle of the frost detection operation may be controlled to be performed when a compressor is operated for a set period of time. Accordingly, in the refrigerator, frost detection may be performed in consideration of a period of operation time of the compressor.

In addition, according to the operation control method for a refrigerator of the present disclosure, when the logic temperature ΔHt checked after the defrosting operation is within a second temperature difference range, it may be determined that residual ice is present on a cold air source. Accordingly, whether residual ice is present may be more accurately recognized.

In addition, according to the operation control method for a refrigerator of the present disclosure, when it is determined that residual ice is present on the cold air source, the defrosting operation may be performed. Accordingly, the residual ice on the cold air source may be completely removed.

In addition, according to the operation control method for a refrigerator of the present disclosure, the defrosting operation may be controlled to be performed when a set period of time elapses from time of a defrosting operation performed immediately before the defrosting operation. Accordingly, it is possible to prevent the loss of cooling capability in the refrigerator which may be caused when the cycle of the defrosting operation is short.

In addition, according to the operation control method for a refrigerator of the present disclosure, the set period of time elapsing from an immediately previous defrosting operation for performing the defrosting operation may be an invariable period of time.

In addition, according to the operation control method for a refrigerator of the present disclosure, the set period of time elapsing from the immediately precious defrosting operation for performing the defrosting operation may be a variable period of time in consideration of the period of operation time of the compressor.

In addition, according to the operation control method for a refrigerator of the present disclosure, when the defrosting operation is continuously performed a plurality of times, a subsequent defrosting operation may be controlled to be performed at every set time period regardless of the frost detection operation. Accordingly, non-performance of the defrosting operation due to the occurrence of an error in the frost detection operation may be prevented.

In addition, according to the operation control method for a refrigerator of the present disclosure, when an error occurs in the frost detection operation, a time period for performing the defrosting operation may be a period according to the period of operation time of the compressor. Accordingly, frost may be prevented from being excessively formed on the cold air source.

In addition, according to the operation control method for a refrigerator of the present disclosure, when the logic temperature is within a third temperature difference range, it may be determined that the inside of the frost detection flow path is blocked.

Furthermore, according to the operation control method for a refrigerator of the present disclosure, when the logic temperature is less than the defrosting temperature difference range, it may be determined that a sensor is frozen.

Additionally, according to the operation control method for a refrigerator of the present disclosure, the defrosting temperature difference range may be set as a temperature difference range when the blocking rate of the cold air source is 50% or more.

In addition, according to the operation control method for a refrigerator of the present disclosure, the initial temperature difference range may be set as a temperature difference range when the blocking rate of the cold air source is less than 50%.

Furthermore, in order to achieve the above objectives, the refrigerator of the present disclosure may include a controller configured to control the first performance cycle to be performed by having a longer term of time than the second performance cycle.

As described above, according to the refrigerator of the present disclosure, a performance cycle for a next frost detection operation according to the logic temperature ΔHt checked through the frost detection operation may be changed, thereby reducing unnecessary power consumption as much as possible and improving power consumption efficiency.

Particularly, according to the refrigerator of the present disclosure, the frost detection operation may be controlled to be more frequently performed when frost is formed to the extent that the defrosting operation is performed than when frost is initially formed after the defrosting operation, and thus the defrosting operation may be performed at an accurate time, thereby preventing the decrease of power consumption efficiency caused due to an inaccurate defrosting operation.

In addition, according to the refrigerator of the present disclosure, when performing the defrosting operation continuously, the defrosting operation may be controlled to be performed only after a set period of time elapses from time in which the performance of a previous defrosting operation ends, thereby preventing the loss of cooling capability in the refrigerator which may be caused due to successive performance of the defrosting operation.

DESCRIPTION OF DRAWINGS

FIG. 1 is a front view schematically illustrating an internal configuration of a refrigerator according to the embodiment of the present disclosure.

FIG. 2 is a vertical sectional view schematically illustrating the configuration of the refrigerator according to the embodiment of the present disclosure.

FIG. 3 is a state view schematically illustrating the state of operation performed according to an operation reference value relative to a reference temperature set by a user for each storage compartment of the refrigerator according to the embodiment of the present disclosure.

FIG. 4 is a view schematically illustrating the structure of a thermoelectric module according to the embodiment of the present disclosure.

FIG. 5 is a block diagram schematically illustrating a refrigeration cycle of the refrigerator according to the embodiment of the present disclosure.

FIG. 6 is a sectional view illustrating the rear space of a second storage compartment in a casing for illustrating the installation state of a frost detection device and an evaporator constituting the refrigerator according to the embodiment of the present disclosure.

FIG. 7 is a rear perspective view of a fan duct assembly for illustrating the installation state of the frost detection device constituting the refrigerator according to the embodiment of the present disclosure.

FIG. 8 is an exploded perspective view illustrating a state in which a flow path cover and a sensor are separated from the fan duct assembly of the refrigerator according to the embodiment of the present disclosure.

FIG. 9 is a rear view of the fan duct assembly illustrating the installation state of the frost detection device constituting the refrigerator according to the embodiment of the present disclosure.

FIG. 10 is an enlarged view illustrating the installation state of the frost detection device constituting the refrigerator according to the embodiment of the present disclosure.

FIG. 11 is an enlarged perspective view illustrating the installation state of the frost detection device constituting the refrigerator according to the embodiment of the present disclosure.

FIG. 12 is a front perspective view of the fan duct assembly constituting the refrigerator according to the embodiment of the present disclosure.

FIG. 13 is an enlarged view illustrating the installation state of the frost detection device according to the embodiment of the present disclosure.

FIG. 14 is a view schematically illustrating the state of a frost check sensor of the frost detection device according to the embodiment of the present disclosure.

FIG. 15 is a block diagram schematically illustrating a control structure of the refrigerator according to the embodiment of the present disclosure.

FIG. 16 is a view illustrating the change of a temperature in a frost detection flow path according to the turning on/off of a heating element and the turning on/off of each cooling fan immediately after defrosting of the evaporator of the refrigerator is completed according to the embodiment of the present disclosure.

FIG. 17 is a flowchart illustrating a control process by a controller during the frost detection operation of the refrigerator according to the embodiment of the present disclosure.

FIG. 18 is a view illustrating the change of a temperature in the frost detection flow path according to the turning on/off of the heating element and the turning on/off of each cooling fan while frost is being formed on the evaporator of the refrigerator according to the embodiment of the present disclosure.

FIG. 19 is a flowchart briefly illustrating a performance process of logic for each logic temperature during the frost detection operation of the refrigerator according to the embodiment of the present disclosure.

FIG. 20 is a flowchart illustrating an operation control for the defrosting operation of the refrigerator according to the embodiment of the present disclosure.

FIG. 21 is a flowchart illustrating the operation control when stopping the defrosting operation of the refrigerator according to the embodiment of the present disclosure.

DETAILED DESCRIPTION

According to the present disclosure, a frost detection operation may be performed in consideration of the end time of a defrosting operation such that power consumption due to the performance of frequent frost detection operation may be reduced and power consumption efficiency may be improved.

In addition, according to the present disclosure, even if there is a problem in the defrosting operation, cooling capability in a refrigerator may be prevented from being lost.

The exemplary embodiments of the structure and operation control of the refrigerator of the present disclosure will be described with reference to FIGS. 1 to 21.

FIG. 1 is a front view schematically illustrating an internal configuration of the refrigerator according to the embodiment of the present disclosure, and FIG. 2 is a vertical sectional view schematically illustrating the configuration of the refrigerator according to the embodiment of the present disclosure.

As illustrated in these drawings, the refrigerator 1 according to the embodiment of the present disclosure may include a casing 11.

The casing 11 may include an outer casing 11*b* constituting the exterior of the refrigerator 1.

In addition, the casing 11 may include an inner casing 11*a* constituting the inner wall surface of the refrigerator 1. A storage compartment in which items are stored may be provided in the inner casing 11*a*.

The storage compartment may include only one storage compartment or at least two storage compartments. In the embodiment of the present disclosure, for example, the storage compartment may include two storage compartments in which items are stored in temperatures different from each other.

The storage compartment may include a first storage compartment 12 maintained at a first set reference temperature.

The first set reference temperature may be a temperature in which stored items do not freeze, and may be in the range of a temperature lower than a temperature (a room temperature) outside the refrigerator 1.

For example, the first set reference temperature may be set in a temperature range of 32° C. or less and above 0° C. Of course, the first set reference temperature may be set to be higher than 32° C., or 0° C. or less when needed (for example, according to a room temperature or the type of a stored item).

Particularly, the first set reference temperature may be the internal temperature of the first storage compartment 12 set by a user, and when the user does not set the first set reference temperature, an arbitrarily designated temperature may be used as the first set reference temperature.

The first storage compartment 12 may be configured to operate with a first operation reference value to maintain the first set reference temperature.

The first operation reference value may be set as a temperature range value including a first lower limit temperature NT−DIFF1. For example, when the internal temperature of the first storage compartment 12 reaches the first lower limit temperature NT−DIFF1 relative to the first set reference temperature, operation for supplying cold air stops.

The first operation reference value may be set as a temperature range value including a first upper limit temperature NT+DIFF1. For example, when the internal temperature rises relative to the first set reference temperature, the operation for supplying cold air may restart before the internal temperature reaches the first upper limit temperature NT+DIFF1.

Accordingly, the supplying of cold air into the first storage compartment 12 may be performed or stopped in consideration of the first operation reference value for the first storage compartment relative to the first set reference temperature.

The set reference temperature NT and the operation reference value DIFF are illustrated in FIG. 3.

In addition, the storage compartment may include a second storage compartment 13 maintained at a second set reference temperature.

The second set reference temperature may be lower than the first set reference temperature. In this case, the second set reference temperature may be set by a user, and when the user does not set the second set reference temperature, an arbitrarily designated temperature may be used as the second set reference temperature.

The second set reference temperature may be a temperature in which a stored item can freeze. For example, the second set reference temperature may be set in a temperature range of 0° C. or less and −24° C. or more. Of course, the second set reference temperature may be set to be higher than 0° C. or −24° C. or less when needed (for example, according to the room temperature or the type of a stored item).

The second set reference temperature may be the internal temperature of the second storage compartment 13 set by a user, and when the user does not set the second set reference temperature, an arbitrarily designated temperature may be used as the second set reference temperature.

The second storage compartment 13 may be configured to operate with a second operation reference value to maintain the second set reference temperature.

The second operation reference value may be set as a temperature range value including a second lower limit temperature NT−DIFF2. For example, when the internal temperature of the second storage compartment 13 reaches the second lower limit temperature NT−DIFF2 relative to the second set reference temperature, operation for supplying cold air stops.

The second operation reference value may be set as a temperature range value including a second upper limit temperature NT+DIFF2. For example, when the internal temperature of the second storage compartment 13 rises relative to the second set reference temperature, operation for supplying cold air may restart before the internal temperature reaches the second upper limit temperature NT+DIFF2.

Accordingly, in consideration of the second operation reference value for the second storage compartment based on the second set reference temperature, the supplying of cold air into the second storage compartment 13 may be performed or stopped.

The first operation reference value may be set to have a smaller range between the upper limit temperature and lower limit temperature than a range between the upper limit temperature and lower limit temperature of the second operation reference value. For example, the second upper limit temperature NT+DIFF2 and second lower limit temperature NT−DIFF2 of the second operation reference value may be set as ±2.0° C., and the first upper limit temperature NT+DIFF1 and first lower limit temperature NT−DIFF1 of the first operation reference value may be set as ±1.5° C.

Meanwhile, the storage compartments described above may be configured such that fluid circulates in each of the storage compartments so that the internal temperature thereof is maintained.

The fluid may be air. In description below, as an example, fluid that circulates through the storage compartment is air. Of course, the fluid may be a gas other than air.

A temperature (a room temperature) outside the storage compartment may be measured by a first temperature sensor 1*a* as illustrated in FIG. 15, and the internal temperature may be measured by a second temperature sensor 1*b* (see FIG. 9).

The first temperature sensor 1*a* and the second temperature sensor 1*b* may be configured separately. Of course, the room temperature and the internal temperature may be measured by the same one temperature sensor, or by at least two temperature sensors in cooperation with each other.

In addition, the storage compartment 12 or 13 may include the door 12*b* or 13*b*.

The door 12*b* or 13*b* may function to open and close the storage compartment 12 or 13, and may be configured as a swinging opening/closing structure or a drawer-type opening/closing structure.

The door 12*b* or 13*b* may include one door or at least two doors.

Next, the refrigerator 1 according to the embodiment of the present disclosure may include a cold air source.

The cold air source may include a structure which generates cold air.

The cold air generation structure of the cold air source may be variously formed.

For example, the cold air source may include a thermoelectric module 23.

As illustrated in FIG. 4, the thermoelectric module 23 may include a thermoelectric element 23*a* including a heat absorbing surface 231 and a heat discharging surface 232. The thermoelectric module 23 may be configured as a module including a sink 23*b* connected to at least one of the heat absorbing surface 231 and the heat discharging surface 232 of the thermoelectric element 23*a*.

In the embodiment of the present disclosure, the cold air generation structure of the cold air source may include an evaporator 21 or 22 and a compressor 60.

The evaporator 21 or 22 may constitute a refrigeration system together with the compressor 60 (see FIG. 5), a condenser (not shown), and an expander (not shown) and may function to exchange heat with fluid (air) passing through the associated evaporator so as to lower the temperature of the fluid.

When the storage compartment includes the first storage compartment 12 and the second storage compartment 13, the evaporator may include the first evaporator 21 for supplying cold air to the first storage compartment 12, and a second evaporator 22 for supplying cold air to the second storage compartment 13.

In this case, inside the inner casing 11*a*, the first evaporator 21 may be located at a rear side of the inside of the first storage compartment 12, and the second evaporator 22 may be located at a rear side of the inside of the second storage compartment 13.

Of course, although not shown, one evaporator may be provided in only one storage compartment of the first storage compartment 12 and the second storage compartment 13.

Even if the refrigerator includes two evaporators, the compressor 60 constituting an associated refrigeration cycle may be only one compressor. In this case, as illustrated in FIG. 5, the compressor 60 may be connected to the first evaporator 21 to supply a refrigerant through a first refrigerant passage 61 to the first evaporator 21, and may be connected to the second evaporator 22 to supply a refrigerant through a second refrigerant passage 62 to the second evaporator 22. In this case, each of the refrigerant passages 61 and 62 may be selectively opened/closed by a refrigerant valve 63.

The refrigerator may include a structure for supplying the generated cold air to the storage compartment.

The cold air supply structure for the cold air source may include may include a cooling fan. The cooling fan may be configured to perform the function of supplying cold air generated by passing through the cold air source to the storage compartments 12 and 13.

In this case, the cooling fan may include a first cooling fan 31 which supplies cold air generated by passing through the first evaporator 21 to the first storage compartment 12.

The cooling fan may include a second cooling fan 41 which supplies cold air generated by passing through the second evaporator 22 to the second storage compartment 13.

Next, the refrigerator 1 according to the embodiment of the present disclosure may include a first duct.

The first duct may be formed as at least one of a passage (e.g., a tube such as a duct or a pipe), a hole, and an air flow path through which air passes. Air may flow from the inside of the storage compartment to the cold air source under the guidance of the first duct.

With reference to FIG. 6, the first duct may include an introduction duct 42*a*. That is, fluid flowing through the second storage compartment 13 may flow into the second evaporator 22 by the guidance of the introduction duct 42*a*.

In addition, the first duct may include a portion of the bottom surface of the inner casing 11*a*. In this case, the portion of the bottom surface of the inner casing 11*a* may be a portion may be a portion ranging from a portion facing the bottom surface of the introduction duct 42*a* to a position in which the second evaporator 22 is mounted. Accordingly, the first duct may provide a flow path through which fluid flows from the introduction duct 42*a* toward the second evaporator 22.

Next, the refrigerator 1 according to the embodiment of the present disclosure may include a second duct.

The second duct may be formed as at least one of a passage (e.g., a tube such as a duct or a pipe, etc.), a hole, and an air flow path which guides air around the evaporator 21 or 22 to be moved to the storage compartment.

The second duct may be the fan duct assembly 30 and 40 located in front of the evaporator 21 and 22.

As illustrated in FIGS. 1 and 2, the fan duct assembly 30 and 40 may include at least one fan duct assembly of a first fan duct assembly 30 which guides the flow of cold air in the first storage compartment 12 and a second fan duct assembly 40 which guides the flow of cold air in the second storage compartment 13.

In this case, space between the fan duct assemblies 30 and 40 of the inside of the inner casing 11*a* in which the evaporators 21 and 22 are respectively located and the rear wall surface of the inner casing 11*a* may be defined as a heat exchange flow path in which fluid exchanges heat with the evaporators 21 and 22.

Of course, although not shown, even if a evaporator is provided only in one of the storage compartments, the fan duct assemblies 30 and 40 may be provided in the storage compartments 12 and 13, respectively, and even if the evaporators 21 and 22 are provided in the storage compartments 12 and 13, respectively, only one of the fan duct assemblies 30 and 40 may be provided. Various configurations are possible.

Meanwhile, in the embodiment described below, for example, the cold air generation structure of the cold air source may be the second evaporator 22, the cold air supply structure for the cold air source may be the second cooling fan 41, the first duct may be the introduction duct 42*a* formed in the second fan duct assembly 40, and the second duct may be the second fan duct assembly 40.

As illustrated in FIGS. 7 to 9, the second fan duct assembly 40 may include a grille panel 42.

In this case, the grille panel 42 may have the introduction duct 42*a* through which fluid is introduced from the second storage compartment 13.

The introduction duct 42*a* may be formed on each of the opposite ends of the lower side of the grille panel 42 and may be configured to guide the intake flow of fluid flowing on an inclined edge portion between the bottom surface and rear wall surface of the inside of the inner casing 11*a* due to a machine room.

In this case, the introduction duct 42*a* may be used as a part of the structure of the first duct described above. That is, the introduction duct 42*a* may guide fluid in the second storage compartment 13 to move to the cold air source 22 (the second evaporator).

In addition, as illustrated in FIGS. 7 to 9, the second fan duct assembly 40 may include a shroud 43.

The shroud 43 may be coupled to the rear surface of the grille panel 42. A flow path for guiding the flow of cold air to the second storage compartment 13 may be provided between the shroud 43 and the grille panel 42.

A fluid inflow hole 43*a* may be formed in the shroud 43. That is, after fluid (cold air) passing through the second evaporator 22 is introduced into the flow path for the flow of cold air located between the grille panel 42 and the shroud 43 through the fluid inflow hole 43*a*, the cold air may pass through each cold air discharge hole 42*b* of the grille panel 42 under the guidance of the flow path and may be discharged into the second storage compartment 13.

The cold air discharge hole 42*b* may include at least two cold air discharge holes. For example, as illustrated in FIGS. 6 and 12, the cold air discharge hole 42*b* may be formed on each of opposite side portions of the upper, middle, lower parts of the grille panel 42.

The second evaporator 22 may be configured to be located under the fluid inflow hole 43*a*.

Meanwhile, the second cooling fan 41 may be installed in a flow path between the grille panel 42 and the shroud 43.

Preferably, the second cooling fan 41 may be installed in the fluid inflow hole 43*a* formed in the shroud 43. That is, due to the operation of the second cooling fan 41, fluid in the second storage compartment 13 may sequentially pass through the introduction duct 42*a* and the second evaporator 22 and then may be introduced to the fluid inflow hole 43*a* through the flow path.

Next, the refrigerator 1 according to the embodiment of the present disclosure may include a frost detection device 70.

The frost detection device 70 may be a device which detects the amount of frost or ice formed on the cold air source.

FIG. 6 is a sectional view illustrating the installation states of the frost detection device and the evaporator according to the embodiment of the present disclosure, and FIGS. 7 to 11 illustrate a state in which the frost detection device is installed in the second fan duct assembly.

As in the embodiment illustrated in these drawings, the frost detection device according to the embodiment of the present disclosure is a device which is located in the flow path of fluid guided by the second fan duct assembly 40 and detects the frost on the second evaporator 22.

In addition, the frost detection device 70 may recognize the degree of frost formed on the second evaporator 22 by using a sensor which outputs different values according to the physical property of fluid. In this case, the physical property may include at least one of a temperature, pressure, and a flow rate.

The frost detection device 70 may be configured such that the execution time of defrosting operation based on the degree of the recognized frost formation may be accurately known.

As illustrated in FIG. 8, the frost detection device 70 may include a frost detection flow path 710.

The frost detection flow path 710 may provide a passage (a flow path) of the flow of air detected by a frost check sensor 730 for checking frost in the second evaporator 22.

The frost detection flow path 710 may be provided as a part in which the frost check sensor 730 for checking frost formed on the second evaporator 22 is located.

The frost detection flow path 710 may be configured as a flow path for guiding a flow of fluid separated from the flow of fluid passing through the second evaporator 22 and the flow of fluid in the second fan duct assembly 40.

In addition, at least a portion of the frost detection flow path 710 may be located in at least one portion of the flow path of cold air circulating through the second storage compartment 13, the introduction duct 42*a*, the second evaporator 22, and the second fan duct assembly 40.

For example, as illustrated as FIG. 9, a fluid inlet 711 of the frost detection flow path 710 may be located to be open to a flow path through which fluid flows to the fluid inflow side of the second evaporator 22 through the introduction duct 42*a*. That is, a portion of fluid introduced into the fluid inlet of the second evaporator 22 through the introduction duct 42*a* may be introduced into the frost detection flow path 710.

A fluid outlet 712 of the frost detection flow path 710 may be located between the fluid outflow side of the second evaporator 22 and a flow path through which cold air is supplied to the second storage compartment 13.

For example, as illustrated in FIG. 9, the fluid outlet 712 of the frost detection flow path 710 may be located to be open to a flow path through which fluid flows to the fluid inflow hole 43*a* of the shroud 43 through the second evaporator 22.

That is, fluid passing through the frost detection flow path 710 may directly flow to a position between the fluid outflow side of the second evaporator 22 and the fluid inflow hole 43*a* of the shroud 43.

In this case, FIGS. 10 and 11 illustrate the installation state of the frost detection device 70 in detail.

Meanwhile, as the amount of frost formed on the second evaporator 22 increases and the flow of fluid passing through the second evaporator 22 is gradually blocked, pressure difference between the fluid inflow side and the fluid outflow side of the second evaporator 22 may gradually increase, and due to the pressure difference, the amount of fluid introduced into the frost detection flow path 710 may gradually increase.

As the amount of fluid introduced into the frost detection flow path 710 increases, the temperature of a heating element 731 constituting the frost check sensor 730 to be described later may decrease, and a temperature difference value (hereinafter, referred to as "a logic temperature") between the turning on and off of the heating element 731 may decrease.

In this case, the logic temperature may be a difference value between a maximum temperature (e.g., a maximum temperature immediately after the turning off of the heating element or during the turning on thereof) and a minimum temperature (e.g., a minimum temperature immediately after the turning on of the heating element or until time of the turning off thereof) which are changed due to heating of the heating element provided in the frost detection flow path.

In consideration of this, it may be known that as the logic temperature $\Delta Ht$ of the inside of the frost detection flow path 710 checked by the frost check sensor 730 decreases, the amount of the frost formed on the second evaporator 22 increases.

When frost does not exist in the second evaporator 22 or the amount of frost is remarkably small therein, most of fluid may pass through the second evaporator 22 in heat exchange space. On the other hand, some of the fluid may flow into the frost detection flow path 710.

For example, based on a state in which frost is not formed on the second evaporator 22, about 98% of fluid introduced through the introduction duct 42*a* may pass through the second evaporator 22 and the remaining 2% of the fluid may pass through the frost detection flow path 710.

In this case, the amount of fluid passing through the second evaporator 22 and the frost detection flow path 710 may gradually vary according to the amount of frost formed on the second evaporator 22.

For example, when frost is formed on the second evaporator 22, the amount of fluid passing through the second evaporator 22 may decrease but the amount of fluid passing through the frost detection flow path 710 may increase.

That is, the amount of fluid passing through the frost detection flow path 710 when frost is formed on the second evaporator 22 may be significantly larger than the amount of fluid passing through the frost detection flow path 710 before frost is formed in the second evaporator 22.

Particularly, it may be preferable to configure the frost detection flow path 710 such that the change of the fluid amount according to the amount of frost formed on the second evaporator 22 may be at least twice. That is, in order to determine the amount of formed frost by using the fluid amount, a detection value to have discrimination power may be obtained when the change of fluid amount between before and after frost is formed at least twice.

When the amount of frost formed in the second evaporator 22 is large enough to require the defrosting operation, the frost of the second evaporator 22 may act as flow resistance, and thus the amount of fluid flowing through the heat exchange space of the associated evaporator 22 may decrease, and the amount of fluid flowing through the frost detection flow path 710 may increase.

Accordingly, according to the amount of frost formed on the second evaporator 22, the amount of fluid flowing through the frost detection flow path 710 may change.

Meanwhile, the frost detection flow path 710 may be formed by being recessed on a surface facing the second evaporator 22 in the grille panel 42 constituting the second fan duct assembly 40 such that fluid flows in the frost detection flow path 710.

In this case, a portion facing the second evaporator 22 which is the rear surface of the frost detection flow path 71 may be formed to be open.

The open rear surface of the frost detection flow path 710 may be configured to be closed by a flow path cover 720.

Of course, although not shown, after the frost detection flow path 710 is manufactured separately from the grille panel 42, the frost detection flow path 710 may be fixed (attached or coupled) to the grille panel 42, or may be provided in the shroud 43.

In addition, the frost detection device 70 may include the frost check sensor 730.

The frost check sensor 730 may be a sensor which measures the physical property of fluid passing through the frost detection flow path 710. In this case, the physical property may include at least one of a temperature, pressure, and a flow rate.

Particularly, the frost check sensor 730 may be configured to calculate the amount of frost formed on the second evaporator 22 based on the difference of an output value changing according to the physical property of fluid passing through the frost detection flow path 710.

That is, based on the difference of an output value checked by the frost check sensor 730, the amount of frost formed on the second evaporator 22 may be used for determining whether the defrosting operation is necessary.

In the embodiment of the present disclosure, the frost check sensor 730 may be a sensor provided to use temperature difference according to the amount of fluid passing through the frost detection flow path 710 such that the amount of frost formed on the second evaporator 22 is checked.

That is, as illustrated in FIG. 13, the frost check sensor 730 may be provided in a portion of the frost detection flow path 710 in which fluid flows, and thus the amount of frost formed on the second evaporator 22 may be checked based on an output value changing according to a fluid flow rate in the frost detection flow path 710.

Of course, the output value may be variously determined by the temperature difference, pressure difference, and other characteristic difference.

As illustrated in FIG. 14, the frost check sensor 730 may include a sensing inductor.

The sensing inductor may be a means for inducing the measurement accuracy of the sensor (a temperature sensor) to be improved such that the sensor may more accurately measure the physical property (or an output value). The sensing inductor may be configured as the heating element 731. The heating element 731 is a heating element that generates heat by receiving power.

As illustrated in FIG. 14, the frost check sensor 730 may include a sensing element 732.

The sensing element 732 is a sensing element which measures a temperature around the heating element 731. That is, when it is considered that a temperature around the heating element 731 changes according to the amount of fluid passing through the heating element 731 through the frost detection flow path 710, this temperature change may be measured by the sensing element 732 and then based on this temperature change, the degree of frost formed on the second evaporator 22 may be calculated.

As illustrated in FIG. 14, the frost check sensor 730 may include the sensor printed circuit board (PCB) 733.

The sensor PCB 733 may be configured to determine the difference between a temperature detected by the sensing element 732 when the heating element is turned off and a temperature detected by the sensing element 732 when the heating element 731 is turned on.

Of course, the sensor PCB 733 may be configured to determine whether the logic temperature $\Delta Ht$ is less than or equal to a reference difference value.

For example, when the amount of frost formed on the second evaporator 22 is small, the amount of fluid flowing through the frost detection flow path 710 may be small, and in this case, heat generated according to the turning on of the heating element 731 may be cooled relatively little by the flowing fluid.

Accordingly, a temperature sensed by the sensing element 732 may increase, and the logic temperature $\Delta Ht$ may also increase.

On the other hand, when the amount of frost formed on the second evaporator 22 is large, the amount of fluid flowing through the frost detection flow path 710 may be large, and in this case, heat generated according to the turning on of the heating element 731 may be cooled relatively much by the flowing fluid.

Accordingly, a temperature detected by the sensing element 732 may decrease, and the logic temperature $\Delta Ht$ may also decrease.

In the end, the amount of frost formed on the second evaporator 22 may be accurately determined according to whether the logic temperature $\Delta Ht$ is high or low, and based on the amount of frost formed on the second evaporator 22 determined in this manner, the defrosting operation may be performed at an accurate time.

That is, when the logic temperature $\Delta Ht$ is high, it may be determined that the amount of frost formed on the second evaporator 22 is small, but when the logic temperature $\Delta Ht$ is low, it may be determined that the amount of frost formed on the second evaporator 22 is large.

Accordingly, a defrosting temperature difference range may be designated and when the logic temperature $\Delta Ht$ is in the defrosting temperature difference range, it may be determined that the defrosting operation of the second evaporator is necessary.

Meanwhile, the frost check sensor 730 may be installed in a direction crossing a direction of fluid passing through the inside of the frost detection flow path 710. In this case, the surface of the frost check sensor 730 and the inner surface of the frost detection flow path 710 may be located to be spaced apart from each other. That is, water may flow down through a gap between the frost check sensor 730 and the frost detection flow path 710. The gap may have a distance such that water does not stagnate between the surface of the frost check sensor 730 and the inner surface of the frost detection flow path 710.

It may be preferable that the heating element 731 and the sensing element 732 are together located on any one surface of the frost check sensor 730.

That is, by placing the heating element 731 and the sensing element 732 on the same surface, the sensing element 732 may more accurately sense a temperature change caused by heat generated by the heating element 731.

In addition, inside the frost detection flow path 710, the frost check sensor 730 may be disposed between the fluid inlet 711 and the fluid outlet 712 of the frost detection flow path 710.

Preferably, the frost check sensor 730 may be disposed at a position spaced apart from the fluid inlet 711 and the fluid outlet 712.

For example, the frost check sensor 730 may be disposed at a center point inside the frost detection flow path 710, at a portion closer to the fluid inlet 711 than to the fluid outlet 712 inside the frost detection flow path 710, or at a portion closer to the fluid outlet 712 than to the fluid inlet 711 inside the frost detection flow path 710.

In addition, the frost check sensor 730 may further include a sensor housing 734. The sensor housing 734 may function to prevent water flowing down on the inside of the frost detection flow path 710 from being in contact with the heating element, the sensing element 732, or the sensor PCB 733.

The sensor housing 734 may be formed to be open at at least one of opposite ends thereof. Accordingly, it is possible to draw out a power line (or a signal line) from the sensor PCB 733.

Next, the refrigerator 1 according to the embodiment of the present disclosure may include a defrosting device 50.

The defrosting device 50 is a component which provides a heat source to remove frost formed on the second evaporator 22.

As illustrated in FIG. 6, the defrosting device 50 may include a first heater 51.

That is, frost formed on the second evaporator 22 may be removed by heat generated by the first heater 51.

The first heater 51 may be located at a lower side of the second evaporator 22. That is, heat generated by the first heater 51 may be provided from the lower end of the second evaporator 22 to an upper end thereof in the direction of fluid flow.

Of course, although not shown, the first heater 51 may be located at a side portion of the second evaporator 22, in front of or behind the second evaporator 22, or above the second evaporator 22, or may be located to be in contact with the second evaporator 22.

The first heater 51 may be configured as a sheath heater. That is, frost formed on the second evaporator 22 is removed by using the radiant heat and convection heat of the sheath heater.

In addition, as illustrated in FIG. 6, the defrosting device 50 may include a second heater 52.

The second heater 52 may be a heater that provides heat to the second evaporator 22 while generating the heat with a lower output than the output of the first heater 51.

The second heater 52 may be located to be in contact with the second evaporator 22. That is, the second heater 52 may be in direct contact with the second evaporator 22 so that the second heater 52 may remove frost formed on the second evaporator 22 through heat conduction.

The second heater 52 may be formed as an L-cord heater. That is, frost formed on the second evaporator 22 may be removed by the conduction heat of the L-cord heater.

In this case, the second heater 52 may be installed to be sequentially in contact with heat exchange fins located on each layer of the second evaporator 22.

A heater included in the defrosting device 50 may include both the first heater 51 and the second heater 52, may include only the first heater 51, or may include only the second heater 52.

Meanwhile, the defrosting device 50 may include a temperature sensor (not shown) for an evaporator.

The temperature sensor for an evaporator may detect a temperature around the defrosting device 50, and the value of the detected temperature may be used as a factor in determining the turning on/off of each of the heaters 51 and 52.

For example, when a temperature value detected by the temperature sensor for an evaporator reaches a specific temperature (a defrost end temperature) after each of the heaters 51 and 52 is turned on, each of the heaters 51 and 52 may be turned off.

The defrosting end temperature may be set as an initial temperature, and when remaining ice is detected in the second evaporator 22, the defrosting end temperature may be increased by a predetermined temperature.

Next, the refrigerator 1 according to the embodiment of the present disclosure may include a controller 80.

As illustrated in FIG. 15, the controller 80 may be a device that controls the operation of the refrigerator 1. The controller may be a microprocessor, an electrical logical circuit, etc.

For example, the controller 80 may control the amount of supplied cold air to be increased such that the internal temperature of the associated storage compartment may decrease when the internal temperature of each of the storage compartments 12 and 13 is in a dissatisfaction temperature range classified on the basis of the set reference temperature NT which a user sets for the associated storage compartment.

The controller 80 may control the amount of supplied cold air to be decreased when the internal temperature of each of the storage compartments 12 and 13 is in a satisfaction temperature range classified on the basis of the set reference temperature NT.

In addition, the controller 80 may be configured to perform the frost detection operation through the frost detection device 70.

Specifically, when the logic temperature ΔHt checked after the performance of the defrosting operation is within a set initial temperature difference range, the controller 80 may perform the frost detection operation according to a first performance cycle.

Here, the set initial temperature difference range may be the range of the logic temperature ΔHt measured in a state in which the blocking rate of the second evaporator 22 is between 0% and 30%. That is, the logic temperature ΔHt measured when frost is not formed or when frost is formed but as not to lower power consumption efficiency may be set as the initial temperature difference range.

In the embodiment of the present disclosure, for example, the initial temperature difference range is greater than or equal to 30 degrees (hereinafter, referred to as "deg") and less than 36 degrees.

The first performance cycle may be a cycle in which the frost detection operation is performed in the case of the initial temperature difference range. The cycle may be set as a cycle longer than a cycle in which every refrigerating operation (an operation of providing cold air into the second storage compartment, for example, at time in which the second cooling fan operates) is performed. For example, the first performance cycle may be a cycle performed every time in which the refrigerating operation is performed a plurality of times.

The initial temperature difference range may be divided into a plurality of temperature difference ranges (for example, 30~32 deg, 33~34 deg, and 35~36 deg), and in the performance cycle of each frost detection operation performed in each of the temperature difference ranges, the first performance cycle may be set to be different according to the logic temperature ΔHt.

For example, the frost detection operation may be set to be performed in a cycle performed at time in which every seventh refrigerating operation is performed when the logic temperature ΔHt is 35 deg, and may be set to be performed in a cycle performed at time in which every second refrigerating operation is performed when the logic temperature ΔHt is 30 deg.

That is, the performance cycle of each frost detection operation performed for each logic temperature of the initial temperature difference range maybe controlled to have a shorter term of time as the logic temperature ΔHt decreases.

Accordingly, the performance of a meaningless frost detection operation may be reduced, and power consumption may be reduced by the reduced number of the meaningless frost detection operations.

In addition, when the logic temperature ΔHt checked through the frost detection operation is within the defrosting temperature difference range, the controller 80 may be configured to perform control for the defrosting operation.

Here, the set defrosting temperature difference range may be the range of the logic temperature ΔHt measured in a state in which the blocking rate of the second evaporator 22 is between 50% and 60%. That is, the logic temperature ΔHt in a case in which power consumption efficiency is rapidly lowered may be set as the defrosting temperature difference range.

In the embodiment of the present disclosure, for example, the defrosting temperature difference range is greater than 12 deg and 24 deg or less.

In addition, when the logic temperature ΔHt checked through the frost detection operation is within a first temperature difference range, the controller 80 may be configured to perform control for the frost detection operation according to a second performance cycle.

Here, the first temperature difference range may be a range between the initial temperature difference range and the defrosting temperature difference range. That is, the logic temperature ΔHt may be set as the first temperature difference range when frost is not formed enough to perform the defrosting operation but to the extent that the defrosting operation should be performed instantaneously.

In the embodiment of the present disclosure, for example, the first temperature difference range is greater than 24 deg and 28 deg or less.

The second performance cycle is a cycle in which the frost detection operation is performed when the logic temperature ΔHt is in the first temperature difference range, and may be a cycle of a shorter term of time than the first performance cycle.

Preferably, the second performance cycle may be controlled to be performed in a cycle of the same term of time regardless of the logic temperature ΔHt.

More specifically, the second performance cycle may be a cycle in which every refrigerating operation (an operation of providing cold air to the second storage compartment) is performed.

For example, when the logic temperature ΔHt is in the first temperature difference range, the frost detection operation may be controlled to be performed every time in which the refrigerating operation is performed.

Of course, the frost detection operation performed in the second performance cycle described above may be performed in at least any one case of a case in which the compressor (not shown) is operated for a set period of time and a case in which cooling operation of the second storage compartment 13 is operated for a set period of time.

In addition, when the logic temperature ΔHt checked through the frost detection operation immediately after the defrosting operation is within a second temperature difference range, the controller 80 may determine that residual ice is present on the second evaporator (the cold air source).

Here, the second temperature difference range may be a range between the initial temperature difference range and the first temperature difference range. That is, the logic temperature ΔHt in a case in which the second evaporator 22 is not blocked to such an extent that the power consumption efficiency is reduced but defrosting to the extent corresponding to the initial temperature difference range is not performed may be set as the first temperature difference range.

In the embodiment of the present disclosure, for example, the second temperature difference range is greater than 28 deg and less than 30 deg.

When determining that residual ice is present in the second evaporator 2, the controller 80 may control the defrosting operation to be performed again.

In this case, the defrosting operation performed again may be performed immediately when the logic temperature ΔHt is included in the second temperature difference range after the associated frost detection operation is performed.

However, when a defrosting operation is performed immediately before the defrosting operation performed again is performed, excessive temperature rise may be caused to the extent that at least a portion of frozen items stored in the second storage compartment 13 melts.

In consideration of this, when performing a defrosting operation again due to residual ice after a normal defrosting operation is performed, it is preferable to perform the defrosting operation again with enough time to minimize temperature change in the second storage compartment 13.

Accordingly, when performing a defrosting operation again due to the detection of the residual ice, the controller according to the embodiment of the present disclosure may control the defrosting operation to be performed again when a set period of time elapses from time in which an immediately previous defrosting operation is performed.

In this case, the set period of time may be an invariable period of time (an unchanging period of time, for example, after four hours from the end time of the defrosting operation), and may be a variable period of time (a changing period of time, for example, when the compressor operates for four hours from end time of the defrosting operation) in consideration of a period of operation time of the compressor.

When the logic temperature ΔHt checked through the frost detection operation is still within the second temperature difference range immediately after the defrosting operation is performed again, the subsequent defrosting operation may be controlled to be performed every time period set by mass production logic regardless of the set period of time (the invariable or variable period of time) or the logic temperature ΔHt checked by a subsequent frost detection operation. In this case, the time period set by the mass production logic may be a period according to a period of operation time of the compressor or a period of operation time for the cooling operation of the second storage compartment.

That is, due to a defrosting operation based on a time period rather than a defrosting operation based on the amount of frost, the loss of cooling capability in the refrigerator due to an excessive defrosting operation may be prevented and the decrease of heat exchange performance due to excessive frost may be prevented.

In addition, when the logic temperature ΔHt checked through the frost detection operation is within the third temperature difference range, the controller 80 may determine that the inside of the frost detection flow path 710 is blocked.

Here, the third temperature difference range may be a higher range than the initial temperature difference range.

In the embodiment of the present disclosure, for example, the third temperature difference range is 36 deg or more.

When determining that the inside of the frost detection flow path 710 is blocked, the controller 80 may control the heating element to generate heat for a predetermined period of time regardless of the frost detection operation.

Of course, the controller may control the defrosting operation to be performed again.

In addition, when the logic temperature ΔHt checked through the frost detection operation is in a fourth temperature difference range, the controller 80 may determine that a sensor (a sensing element) is frozen.

Here, the fourth temperature difference range may be a lower range than the defrosting temperature difference range.

In the embodiment of the present disclosure, for example, the fourth temperature difference range is greater than or equal to 8 deg and less than or equal to 12 deg.

When it is determined that the sensor is frozen, the controller 80 may control the heating element to generate heat for a predetermined period of time regardless of the frost detection operation. Of course, the controller 80 may control the defrosting operation to be performed again.

Next, an operation control process performed by the controller for the frost detection operation of the refrigerator 1 according to the embodiment of the present disclosure will be described.

FIG. 17 is a flowchart of a method of performing defrosting operation by determining time in which defrosting of the refrigerator is required according to the embodiment of the present disclosure, and FIGS. 16 and 18 are views illustrating the change of a temperature measured by the frost check sensor before and after frost is formed on the second evaporator according to the embodiment of the present disclosure.

FIG. 16 illustrates the temperature change of the second storage compartment 13 and the temperature change of the heating element before frost is formed on the second evaporator 22, and FIG. 18 illustrates the temperature change of the second storage compartment and the temperature change of the heating element while frost is formed on the second evaporator.

As illustrated in these drawings, after previous defrosting operation is completed at S1, the cooling operation of each of the storage compartments 12 and 13 based on the first set reference temperature and the second set reference temperature may be performed by the control of the controller 80 at S110.

In this case, the cooling operation described above may be performed through the operation control of at least any one of the first evaporator 21 and the first cooling fan 31 according to the first operation reference value designated on the basis of the first set reference temperature, and may be performed through the operation control of at least any one of the second evaporator 22 and the second cooling fan 41 according to the second operation reference value designated on the basis of the second set reference temperature.

For example, the controller 80 may control the first cooling fan 31 to operate when the internal temperature of the first storage compartment 12 is in the dissatisfaction temperature range classified on the basis of the first set reference temperature set by a user, and may control the first cooling fan 31 to stop when the internal temperature is in the satisfaction temperature range.

Particularly, when the internal temperature of the first storage compartment 12 reaches the first lower limit temperature NT−DIFF1 based on the first set reference temperature, the controller 80 may stop an operation for supplying cold air.

On the other hand, when the internal temperature rises relative to the first set reference temperature, the operation for supplying cold air may restart before the internal temperature reaches the first upper limit temperature NT+DIFF1.

The controller 80 may control the first refrigerant passage 61 to be closed and the second refrigerant passage 62 to be opened by controlling the refrigerant valve 63 after the internal temperature of the first storage compartment 12 reaches the first lower limit temperature NT−DIFF1.

In this case, the controller 80 may control the first cooling fan 31 to be operated for a predetermined period of time after the internal temperature of the first storage compartment 12 reaches the first lower limit temperature NT−DIFF1.

In addition, the controller 80 may control the first refrigerant passage 61 to be opened and the second refrigerant passage 62 to be closed by controlling the refrigerant valve 63 before the internal temperature of the first storage compartment 12 reaches the first upper limit temperature NT+DIFF.

In this case, the controller 80 may control cold air to be supplied by operating the first cooling fan 31, and may control the amount of cold air supplied by the second cooling fan 41 to be decreased.

In addition, during the normal cooling operation described above, it may be continuously checked whether a cycle for the frost detection operation has been reached at S120.

In this case, the performance cycle of the frost detection operation may be determined by checking the temperature difference range to which the logic temperature ΔHt checked through a immediately previous frost detection operation belongs.

When the logic temperature ΔHt is included in the initial temperature difference range, the performance cycle of the frost detection operation may be determined based on the first performance cycle.

Particularly, even if the first performance cycle is in the initial temperature difference range, the performance cycle may be set to be different for each temperature difference value, and may basically be a cycle performed every time in which the refrigerating operation (the operation of the second cooling fan) is performed two times or more and a plurality of times.

Preferably, the first performance cycle may be a cycle performed every time in which the refrigerating operation is performed a plurality of times and may be set to be performed after the cumulative operation time of the compressor exceeds at least one hour, or may be set to be performed by considering the cumulative operation time of the compressor.

When the frost detection operation is performed, the cumulative operation time of the compressor may be initialized.

When the logic temperature ΔHt is included in the second temperature difference range, the performance cycle of the frost detection operation may be determined based on the second performance cycle.

In this case, the second performance cycle may be a cycle performed at a time in which each refrigerating operation (the operation of the second cooling fan) is performed.

For example, the first performance cycle may be a cycle performed every time in which the refrigerating operation is performed a plurality of times.

That is, when it is considered that the frost detection device 70 is configured to check the amount of frost formed on the second evaporator 22 on the basis of the temperature difference value ΔHt (the logic temperature) according to the change of the flow rate of fluid passing through the frost detection flow path 710, as the logic temperature ΔHt increases, the reliability of a detection result by the frost detection device 70 may be secured, and the largest logic temperature AΔHt may be obtained during a cooling operation in which the second cooling fan 41 operates.

Furthermore, when the performance cycle for the frost detection operation is reached, the frost detection operation may be performed.

In this case, the frost detection operation may be performed when the second cooling fan operates, and thus when the frost detection operation is performed, fluid may flow into the frost detection flow path 710.

That is, due to the operation of the second cooling fan, fluid in the second storage compartment may sequentially circulate through the introduction duct 42*a*, the second evaporator 22, and the second fan duct assembly 40, and in this process, some of the fluid flowing to the second evaporator 22 through the introduction duct 42*a* may be introduced into the frost detection flow path.

When the frost detection operation is performed, power may be supplied to the heating element 731 by the control of the controller 80 (or the control of the sensor PCB) and the heating element 731 may generate heat at S141.

In addition, when heating of the heating element 731 is performed, the sensing element 732 may detect the physical property of fluid in the frost detection flow path 710, that is, a temperature Ht1 of the fluid at S142.

The sensing element 732 may detect the temperature Ht1 simultaneously with the heating of the heating element 731, or may detect the temperature Ht1 immediately after the heating of the heating element 731 is performed.

Particularly, the temperature Ht1 detected by the sensing element 732 may be the lowest temperature of the inside of the frost detection flow path 710 that is checked after the heating element 731 is turned on.

The detected temperature Ht1 may be stored in the controller 80 (or the sensor PCB).

In addition, the heating of the heating element 731 may be performed during the set period of heating time. In this case, the set period of heating time may be enough period of time to discriminate the change of the internal temperature of the frost detection flow path 710.

For example, when the heating element 731 generates heat for the set period of heating time, discrimination power may be obtained except for the logic temperature ΔHt due to other factors predicted or unpredicted.

The set period of heating time may be a specific period of time or may be a period of time that varies according to a surrounding environment.

In addition, when the set period of heating time elapses, power supply to the heating element 731 may be cut off and heat generation by the third heater 53 may stop at S143.

Of course, even if the period of heating time does not elapse, power supply to the heating element 731 may be controlled to be stopped.

For example, when a temperature detected by the temperature sensor 732 exceeds a set temperature value (for example, 70° C.), power supply to the heating element 731 may be controlled to be stopped, and when the door of the second storage compartment 13 is opened, power supply to the heating element 731 may be controlled to be stopped.

In addition, when the heating of the heating element 731 stops, the physical property of fluid, that is, a temperature Ht2 of the fluid in the frost detection flow path 710 may be detected by the sensing element 732 at S144.

In this case, temperature detection by the sensing element 732 may be performed at the same time in which the heating of the heating element 731 stops, or immediately after the heating of the heating element 731 stops.

Particularly, the temperature Ht2 detected by the temperature sensor 732 may be a maximum internal temperature of the frost detection flow path 710 checked before and after the heating element 731 is turned off.

The detected temperature Ht2 may be stored in the controller 80 (or the sensor PCB).

In addition, the controller 80 (or the sensor PCB) may calculate the logic temperature ΔHt between detected temperatures Ht1 and Ht2 on the basis of the detected temperatures Ht1 and Ht2 at 1145, and on the basis of the calculated logic temperature ΔHt, a logic for each temperature difference range may be determined at S160.

In this, logic for each of the temperature difference ranges may include logic of at least one of an operation in the first performance cycle, an operation in the second performance cycle, whether the defrosting operation is performed, whether the frost detection flow path is blocked, whether the sensor is frozen, and whether the sensor fails.

For example, as illustrated in the flowchart of FIG. 19, when the checked logic temperature is within the initial temperature difference range, the operation in the first performance cycle may be controlled to be performed.

When the checked logic temperature is within the first temperature difference range, the operation in the second performance cycle may be controlled to be performed.

When the checked logic temperature is within the second temperature difference range, it may be checked whether a immediately previous defrosting operation has been performed, and when it is checked that the logic temperature is a logic temperature immediately after the defrosting operation, it may be determined that there is residual ice at S161.

When the checked logic temperature is within the third temperature difference range, it may be determined that the frost detection flow path 710 is blocked at S162, and an operation (for example, a defrosting operation, notification to a user, or heating of the heating element, etc.) for solving this may be controlled to be performed.

When the checked logic temperature is within the fourth temperature difference range, it may be determined that the sensing element 732 constituting the frost check sensor 730 is frozen at S163, and an operation (for example, a defrosting operation, notification to a user, or heating of the heating element, etc.) for solving this may be controlled to be performed.

When the checked logic temperature is within the defrosting temperature difference range, the defrosting operation may be controlled to be performed.

When the checked logic temperature indicates an abnormal temperature value such as −70° C. or 100° C., it may be determined that the sensing element 732 constituting the frost check sensor 730 has failed.

Furthermore, when the frost detection operation by the above process ends, an associated frost detection operation may not be performed until the next performance cycle is reached.

When logic checked through the frost detection operation is logic requiring a defrosting operation, the defrosting operation may be controlled to be performed at S2.

In this case, when the defrosting operation is performed, a pre-stored logic temperature ΔHt for each frost detection cycle may be reset.

Next, the process S2 of performing the defrosting operation for the second evaporator 22 of the refrigerator according to the embodiment of the present disclosure will be described with reference to the flowcharts of FIGS. 20 and 21.

First, the defrosting operation S2 of FIG. 20 may be performed by the determination of the controller 80 based on the logic temperature ΔHt checked through the frost detection operation after the frost detection operation is performed.

When performing the defrosting operation at S2, it may be checked whether an immediately previous defrosting operation has been performed at S210, and when the immediately previous defrosting operation has been performed, elapsed time may be checked at S220.

When the immediately previous defrosting operation has elapsed a set period of time, a normal defrosting operation may be performed, but when the immediately previous defrosting operation has not elapsed in the set period of time, the defrosting operation may not be performed until the set period of time elapses.

That is, it is possible to prevent the loss of cooling capability in the refrigerator which may be caused when the defrosting operation is performed again without elapsing in the set period of time.

Of course, even when the set period of time has not elapsed and the defrosting operation is not performed, the frost detection operation may be performed according to a predetermined performance cycle.

During the performance of the defrosting operation, the first heater 51 constituting the defrosting device 50 may generate heat at S230.

That is, heat generated by the second heater 52 may remove frost formed on the second evaporator 22.

In this case, when the first heater 51 is configured as the sheath heater, heat generated by the first heater 51 may remove frost formed in the second evaporator 22 through radiation and convection.

In addition, during the defrosting operation, the second heater 52 constituting the defrosting device 50 may generate heat at S230.

That is, heat generated by the second heater 52 may remove frost formed on the second evaporator 22.

In this case, when the second heater 52 is configured as the L-cord heater, heat generated by the second heater 52 may conduct heat to the exchange fins and remove frost that has formed on the second evaporator 22.

The first heater 51 and the second heater 52 may be controlled to simultaneously generate heat, or after the first heater 51 first generates heat, the second heater 52 may be controlled to generate heat, or after the second heater 52 first generates heat, the first heater 51 may be controlled to generate heat.

In addition, after heating of the first heater 51 or the second heater 52 is performed for a set period of time, the heating of the first heater 51 or the second heater 52 may stop at S240.

In this case, even if the first heater 51 and the second heater 52 provide heat together, the two heaters 51 and 52 may simultaneously stop generating heat, but any one heater first may stop generating heat, and then the other heater may stop generating heat.

A period of time set for heating of each of the heaters 51 and 52 may be set as a specific period of time (e.g., one hour), or may be set as a period of time changing according to the amount of formed frost.

In addition, the first heater 51 or the second heater 52 may operate with a maximum load or a variable load according to the amount of defrosting.

Furthermore, when the defrosting operation is performed according to the operation of the defrosting device 50, the heating element 731 constituting the frost check sensor 730 may also be controlled to generate heat.

That is, when it is considered that water generated by frost melting during the defrosting operation may flow down into the frost detection flow path 710, the heating element 731 may also generate heat such that the water flowing down does not freeze in the frost detection flow path 710.

In addition, the defrosting operation may be performed based on at least one factor of time and temperature.

That is, the defrosting operation may be controlled to end when the defrosting operation is performed for a certain period of time, and when the temperature of the second evaporator 22 reaches a set temperature.

In addition, as illustrated in the flowchart of FIG. 21, when the operation of the defrosting device 50 described above is completed, the first cooling fan 31 may operate with a maximum load at S251 such that the first storage compartment 12 reaches a set temperature range, and then the second cooling fan 41 may operate with a maximum load S252 such that the second storage compartment 13 reaches a set temperature range.

In this case, during the operation of the first cooling fan 31, a refrigerant compressed from the compressor 60 may be controlled to be provided to the first evaporator 21, and during the operation of the second cooling fan 41, a refrigerant compressed from the compressor 60 may be controlled to be provided to the second evaporator 22.

In addition, when a temperature condition of each of the first storage compartment 12 and the second storage compartment 13 is in a satisfied condition, the frost detection operation for detecting the formation of frost on the second evaporator 22 performed by the frost detection device 70 may be performed again.

Meanwhile, a new logic temperature ΔHt may be checked by the frost detection operation performed immediately after the defrosting operation.

In this case, based on the checked logic temperature ΔHt, the controller 80 may determine that the logic temperature is in logic of at least one of whether residual ice is detected, whether defrosting malfunctions, and whether the inside of the frost detection flow path is blocked.

When the checked logic temperature is included in the second temperature difference range, it may be determined that residual ice is present at S161 (see FIG. 19).

When the checked logic temperature is included in the defrosting temperature difference range, it may be determined that the defrosting has not been performed.

When the checked logic temperature is included in the third temperature difference range, it may be determined that the inside of the frost detection flow path is blocked at S162.

Accordingly, when the controller 80 determines in any one logic of the logics, the defrosting operation may be performed again such that at least any one of the removal of residual ice, the removal of frost, and the removal of a flow path blockage is performed.

As described above, when performing the defrosting operation again, it may be further checked whether a set period of time has elapsed after the immediately previous defrosting operation. That is, it is possible to prevent the loss of cooling capability in the refrigerator which may be caused when the defrosting operation is performed again without elapsing the set period of time.

When a set time has not elapsed, the defrosting operation may be controlled so as not to be performed until the set time is reached.

Of course, even when the set period of time has not elapsed and the defrosting operation is not performed, the frost detection operation may be performed according to a predetermined performance cycle.

In addition, when it is determined that the inside of the frost detection flow path 710 is blocked since the logic temperature checked by the frost detection operation is included in the third temperature difference range, the defrosting operation may be controlled to be performed.

That is, during the defrosting operation, defrost water may be introduced into the frost detection flow path 710, and when this introduced defrost water is not efficiently discharged, some of the defrost water may remain and may block the inside of the associated frost detection flow path 710.

When it is determined that the inside the frost detection flow path 710 is blocked, frost frozen in the frost detection flow path 710 may be melted through the performance of the defrosting operation.

However, even if the defrosting operation is performed to eliminate the blockage inside of the frost detection flow path 710, the inside of the frost detection flow path 710 may remain blocked.

Accordingly, when it is determined that the inside of the frost detection flow path 710 remains blocked through the frost detection operation immediately after the defrosting operation despite the performance of the defrosting operation a plurality of times (for example, two times) for eliminating the blockage of the inside of the frost detection flow path 710, the logic temperature ΔHt checked by further frost detection operation may be ignored, and the defrosting operation may be preferably controlled to be performed every time period set by initial mass production logic.

Of course, the operation of determining whether the blockage of the inside of the frost detection flow path 710 is eliminated may be continuously performed. Instead of the defrosting operation by using the defrosting device, the control of eliminating freezing of the inside of the frost detection flow path 710 by using heat generated by the heating element 731 may be additionally performed.

Accordingly, in the refrigerator 1 of the present disclosure, a performance cycle for a next frost detection operation according to the logic temperature ΔHt checked through the frost detection operation may be changed, thereby reducing unnecessary power consumption as much as possible and improving consumption efficiency.

In addition, in the refrigerator of the present disclosure, when performing the defrosting operation continuously, the defrosting operation may be controlled to be performed only after a set period of time elapses from time in which a previous defrosting operation ends, thereby preventing the loss of cooling capability in the refrigerator which may be caused due to the successive performance of the defrosting operation.

Meanwhile, the refrigerator of the present disclosure is not limited to being applied only to a structure having two storage compartments or two evaporators.

That is, the refrigerator of the present disclosure may be applied to a refrigerator of a structure in which only one storage compartment is provided, and of a structure in which only one evaporator is provided. Various configurations are applicable.

Accordingly, the refrigerator of the present disclosure may be applied to various models.

The invention claimed is:

1. An operation control method for a refrigerator, the method comprising:

checking in a frost detection operation a logic temperature (ΔHt) which is a temperature difference of fluid passing through an inside of a frost detection flow path based on a cycle of the frost detection operation is reached or after a defrosting operation is performed, the defrosting operation is performed for removing frost on an evaporator based on the logic temperature (ΔHt) being within a defrosting temperature difference range, performing the frost detection operation every first performance cycle in response to the logic temperature (ΔHt) checked after performing the defrosting operation is within a set initial temperature difference range, and performing the frost detection operation every second performance cycle in response to the logic temperature (ΔHt) checked after performing the defrosting operation is within a first temperature difference range between the set initial temperature difference range and the defrosting temperature difference range, and the first performance cycle is performed to have a longer term of time than the second performance cycle, wherein the first performance cycle of each frost detection operation performed for each logic temperature of the initial temperature difference range is controlled to have a shorter term of time as the logic temperature ΔHt decreases.

2. The method of claim 1, wherein the logic temperature (ΔHt) checked through the frost detection operation is a difference between a highest temperature and a lowest temperature of the fluid due to heat generated by a heating element provided in the frost detection flow path.

3. The method of claim 1, wherein the initial temperature difference range is divided into at least two temperature difference ranges, the method comprises controlling a performance cycle of each frost detection operation performed in each of the temperature difference ranges to have a shorter term of time as the logic temperature (ΔHt) decreases.

4. The method of claim 1, comprises performing the second performance cycle of each frost detection operation performed in the first temperature difference range to have a same term of time regardless of the logic temperature (ΔHt).

5. The method of claim 1, comprises performing the frost detection operation in the second performance cycle based on a compressor operated for a set period of time.

6. The method of claim 1, comprises determining that residual ice is present in the evaporator based on the logic temperature (ΔHt) checked immediately after the defrosting operation is within a second temperature difference range which is a temperature difference range higher than the first temperature difference range and lower than the initial temperature difference range.

7. The method of claim 6, comprises performing the defrosting operation based on the determination that the residual ice is present in the evaporator.

8. The method of claim 1, comprises determining that the inside of the frost detection flow path is blocked based on the logic temperature (ΔHt) checked in the frost detection operation is within a third temperature difference range higher than the initial temperature difference range.

9. The method of claim 8, comprises performing the defrosting operation based on the determination that the inside of the frost detection flow path is blocked.

10. The method of claim 9, comprises repeatedly performing the defrosting operation a plurality of times based on the determination that the inside of the frost detection flow path is blocked, a next defrosting operation performed after the defrosting operation is performed every set time period regardless of the frost detection operation.

11. The method of claim 1, comprises determining that a sensor is frozen based on the logic temperature (ΔHt) checked in the frost detection operation is less than the defrosting temperature difference range.

12. The method of claim 1, wherein the defrosting temperature difference range is a temperature difference range when a blocking rate of the evaporator is 50% or more.

13. The method of claim 1, wherein the initial temperature difference range is a temperature difference range when a blocking rate of the evaporator is less than 50%.

14. A refrigerator comprising:

a casing which provides a storage compartment;

an evaporator which cools fluid;

a duct which supplies fluid cooled by the cold air source to the storage compartment;

a frost detection device which detects frost formed on the evaporator, a controller which controls the fluid supply module and the frost detection device based on whether frost detected by the frost detection device is present, the frost detection device comprises: a frost detection flow path which guides a portion of the fluid flowing from the storage compartment or a portion of the fluid flowing back from the evaporator to bypass the evaporator without passing therethrough in a state in which the frost detection flow path is separated from a heat exchange flow path and the portion of the fluid flows toward the storage compartment; and a frost check sensor provided at the frost detection flow path and measures a physical property of the portion of the fluid passing through the frost detection flow path, the frost check sensor comprises: a heater; and a sensor which detects a logic temperature (ΔHt) which is temperature difference of the portion of the fluid between turning on and off of the heating element; and a controller configured to:

perform a frost detection operation every first performance cycle based on the logic temperature (ΔHt) checked after performing a defrosting operation is within a set initial temperature difference range, perform the frost detection operation every second performance cycle based on the logic temperature (ΔHt) checked after the performance of the defrosting operation is within a first temperature difference range between the set initial temperature difference range and a defrosting temperature difference range, and control the first performance cycle to be performed by having a longer term of time than the second performance cycle, wherein the first performance cycle of each frost detection operation performed for each logic temperature of the initial temperature difference range is controlled to have a shorter term of time as the logic temperature ΔHt decreases.

* * * * *